US005429482A

United States Patent [19]

Takenaka et al.

[11] Patent Number: 5,429,482

[45] Date of Patent: Jul. 4, 1995

[54] RECIPROCATORY PISTON TYPE COMPRESSOR

[75] Inventors: Kenji Takenaka; Kazuya Kimura; Hiroaki Kayukawa; Chuichi Kawamura, all of Kariya, Japan

[73] Assignee: Kabushiki Kaisha Toyoda Jidoshokki Seisakusho, Aichi, Japan

[21] Appl. No.: 16,013

[22] Filed: Feb. 10, 1993

Related U.S. Application Data

[63] Continuation-in-part of Ser. No. 942,989, Sep. 10, 1992, abandoned.

[30] Foreign Application Priority Data

| | | | |
|---|---|---|---|
| Feb. 10, 1992 | [JP] | Japan | 4-023983 |
| Sep. 11, 1992 | [JP] | Japan | 4-231853 |
| Sep. 11, 1992 | [JP] | Japan | 4-231856 |
| Sep. 13, 1992 | [JP] | Japan | 4-235026 |

[51] Int. Cl.[6] ..... F04B 27/08

[52] U.S. Cl. ..... 417/269; 417/516; 417/519; 137/674.13; 137/876; 251/208

[58] Field of Search ..... 417/269, 517, 519, 516; 91/485; 137/624.13, 876; 251/208

[56] References Cited

U.S. PATENT DOCUMENTS

| | | | |
|---|---|---|---|
| 1,364,508 | 1/1921 | Moody . | |
| 1,367,914 | 2/1921 | Larsson . | |
| 3,479,963 | 11/1969 | Randa et al. | 91/485 |
| 3,498,227 | 3/1970 | Kita | 417/269 |
| 3,799,033 | 12/1971 | Pruvot | 91/485 |
| 5,232,349 | 8/1993 | Kimura et al. | 417/269 |
| 5,267,839 | 12/1993 | Kimura et al. | 417/269 |
| 5,286,173 | 2/1994 | Takenaka et al. | 417/269 |

FOREIGN PATENT DOCUMENTS

| | | |
|---|---|---|
| 350135 | 3/1922 | Germany . |
| 3-63785 | 6/1991 | Japan . |

*Primary Examiner*—Richard A. Bertsch
*Assistant Examiner*—William J. Wicker
*Attorney, Agent, or Firm*—Burgess, Ryan and Wayne

[57] ABSTRACT

A reciprocatory piston type compressor having a compressor body in which a low pressure suction chamber for the refrigerant before compression, a discharge chamber for the refrigerant after compression, and a plurality of axial cylinder bores receiving a corresponding number of reciprocatory pistons are provided therein, and a rotating plate suction valve capable of mechanically and forcibly opening suction ports in synchronism with the suction stroke of the reciprocatory pistons to thereby permit the refrigerant gas before compression to be drawn into the cylinder bores without time delay. A discharge valve capable of mechanically and forcibly open the discharge ports in synchronism with the discharge stroke of the pistons is also provided in the compressor body.

1 Claim, 17 Drawing Sheets

RECIPROCATORY PISTON TYPE COMPRESSOR

CROSS-REFERENCE TO RELATED APPLICATION

This is a continuation-in-part application of the copending U.S. patent application Ser. No. 942,989 filed on Sep. 10, 1992, now abandoned.

BACKGROUND OF THE INVENTION

1. Field of the Invention

The present invention relates to a reciprocatory piston type multi-cylinder refrigerant compressor for a refrigeration system accommodated in an automobile, and more particularly, it relates to a reciprocatory piston type compressor provided with an improved internal construction thereof capable of preventing pressure loss before delivery of the compressed refrigerant gas and of suppressing vibration and noise.

2. Description of the Related Art

Reciprocatory piston type refrigerant compressors such as a wobble plate operated reciprocatory piston type variable displacement compressor, and a swash plate operated reciprocatory piston type fixed displacement compressor are conventionally used for compressing a refrigerant circulating through a refrigeration system of e.g., an automobile air conditioner.

U.S. Pat. No. 4,732,545 assigned to the same Assignee as the present patent application discloses a typical wobble plate type compressor.

FIGS. 23 and 24 illustrate a conventional wobble plate type variable displacement refrigerant compressor similar to the compressor disclosed in the above-mentioned U.S. Pat. No. 4,732,545. In FIGS. 23 and 24, the wobble plate type compressor is provided with an axial cylinder block 90 having a-plurality of cylinder bores 91 arranged around and parallel to a central axis of the cylinder block 90, and a plurality of single headed pistons 92 reciprocated in the respective cylinder bores 91 to compress the refrigerant in the form of a gas. The compressor having single headed pistons 92 is also provided with a front housing 94 attached by bolts 90*a* to one of the axial ends, i.e., a front end of the cylinder block 90 to define a crank chamber 93 therein, and a rear housing 98 attached by the same bolts 90*a* to the other end, i.e., a rear end of the cylinder block 90 via a suction valve sheet 95, a valve plate 96, and a discharge valve sheet 97 to define an outer suction chamber 87 and a discharge chamber 88. The suction and discharge valve sheets 95 and 97 are formed with a plurality of flapper type suction and discharge valves 95*a* and 97*a* therein, respectively. The movement of the flapper type discharge valves 97*a* of the discharge valve sheet 97 from the closed position thereof to the open position is limited by a retainer element 89 disposed in the discharge chamber 88.

An axial drive shaft 80 is arranged in the crank chamber 93 of the front housing 94 to extend coaxially with a central axis of the cylinder block 90. The drive shaft 80 has one end thereof, i.e., a front end extending outwardly beyond the frontmost end of the front housing 94 via a shaft seal 99*a* and a front rotary bearing 99*b*, and the other end thereof supported by a rear rotary bearing 99*c* seated in a central bore 90*b* of the cylinder block 90. Thus, the axial drive shaft 80 is rotatable in the crank, chamber 93.

A rotor 81 is fixed to a part of the drive shaft 80 so as to be rotated together with the drive shaft 80, and axially supported by a thrust bearing 81*a* seated on the inner face of the front housing 94. A sleeve element 82 is slidably mounted on the drive shaft 80, and axially and frontwardly pressed by a spring element (not illustrated in FIG. 1). The rotor 81 is formed with an elongated through-hole 81*b* in which a pin 83*a* is movably engaged connecting the rotor 81 to a swash plate 83 that is pivotally supported by the sleeve element 82 via a pair of lateral trunnion pins 82*a*. The swash plate 83 pivoting about the trunnion pins 82*a* so as to assume a variably inclined position thereof with respect to a plane vertical to the axis of the drive shaft 80 is rotatable with the drive shaft 80.

A non-rotatable wobble plate 85 is supported on the swash plate 83 via a thrust bearing 84*a* and a cylindrical slide bearing 10, and is provided with a radially outermost portion 85*a* thereof engaged with one of the bolts 90*a* thereby preventing same from being rotated together with the swash plate 83. Thus, only a pivotal motion of the swash plate 83, thereby changing the angle of inclination thereof about the trunnion pins 82*a*, is transmitted to the wobble plate 85.

The wobble plate 85 has a rear end face having sockets formed therein for movably receiving one ball-end of each of a plurality of connecting rods 86 connected, via the other ball-ends thereof, to the afore-mentioned pistons 92. Therefore, when the drive shaft 80 is rotated by an outer drive power source, such as a vehicle engine, the swash plate 83 is rotated together to cause a wobbling motion of the non-rotatable wobble plate 85, thereby reciprocating the pistons 92 in the respective axial cylinder bores 91 of the cylinder block 90. The volume of respective cylinder bores 91 is changed by the reciprocation of the pistons 92 from the top to bottom dead centers thereof and vice versa in the corresponding cylinder bores 91. Therefore, the refrigerant gas is drawn from the suction chamber 87 of the rear housing 98 into the respective cylinder bores 91 to be compressed by the reciprocated pistons 92 in the cylinder bores 91, and is discharged toward the discharge chamber 88 of the rear housing 90.

As is clearly shown in FIG. 23, the suction chamber 87 of the rear housing 98 has an annular form, and is arranged radially outside the discharge chamber 88 via a partition wall. The outer suction chamber 87 is provided with a suction inlet 87*a* for introduction of the refrigerant gas from the external refrigerating circuit of a vehicle refrigerating system, and the discharge chamber 88 is provided with a delivery outlet 88*a* for delivery of the compressed refrigerant gas toward the external refrigerating circuit.

A plurality of suction ports 96*a* (in most cases, the number is equal to that of the cylinder bores 91) are formed in the outer peripheral portion of the valve plate 96 and the discharge valve sheet 97 in such an arrangement that the respective suction ports 96*a* are substantially axial in alignment with the respective cylinder bores 91. The suction ports 96*a* provide a fluid communication between the suction chamber 87 and the respective cylinder bores 91 during the suction stroke of the reciprocatory pistons 92 in the respective cylinder bores 91 from the top dead center to the bottom dead center, thereby enabling the refrigerant gas before compression to be drawn from the suction chamber 87 into the volume-increasing cylinder bores 91 through the flapper type suction valves 95*a* of the suction valve sheet 95 elastically moved to their opening positions.

Similarly, a plurality of discharge ports 96b (the number is equal to the number of cylinder bores 91) are formed in the radially internal portion of the suction valve sheet 95 and the valve plate 96 in such an arrangement that the respective discharge ports 96b are substantially axial in alignment with the respective cylinder bores 91. The respective discharge ports 96b provide a fluid communication between the respective cylinder bores 91 and the discharge chamber 88 during the discharge stroke of the respective reciprocatory pistons 92 from the bottom dead center to the top dead center, thereby enabling the compressed refrigerant gas to be discharged from the volume-decreasing cylinder bores 91 toward the discharge chamber 88 through the flapper type discharge valves 97a of the discharge valve sheet 97 elastically moved to their opening positions limited by the retainer 89.

Nevertheless, with the conventional wobble plate type variable displacement refrigerant compressor of FIGS. 23 and 24, it should be noted that each of the suction and discharge valves 95 and 97 in the flapper form is made of a thin elastic plate material so that the valve is constantly elastically urged toward the closing position thereof. Therefore, the flapper valve must always be moved from the closing to opening position thereof against the elastic force exerted by the valve per se, and accordingly, a delay in the suction of the refrigerant gas and a delay in the discharge of the compressed refrigerant gas occur, and as a result, a considerable amount of refrigerant pressure loss occurs, thereby lowering the volumetric efficiency of the compressor. The pressure loss becomes great either when a high load is applied to the compressor or when the compressor is operated at a high speed.

Further, when the suction or discharge valve in the flapper form returns to the closing position thereof, it strikes against the end face of the valve plate and produces a loud noise, and may additionally be damaged or broken.

Moreover, the above-mentioned delay in the suction of the refrigerant gas before compression into the cylinder bores will cause the gas to make contact with the partition wall between the suction and discharge chambers 87 and 88 in the course of the gas flowing from the suction inlet 87a to the cylinder bores 91. Therefore, the refrigerant gas before compression is exposed to heat transmitted from the high temperature discharge chamber 88 via the partition wall and accordingly, the refrigerant gas before compression is thermally expanded prior to entering the cylinder bores 91. The thermally expanded refrigerant gas thus cannot be sufficiently compressed by the reciprocatory pistons 92 within the cylinder bores 91, and therefore an adverse affect is imparted to the compressing performance of the compressor.

SUMMARY OF THE INVENTION

An object of the present invention is to provide a reciprocatory piston type refrigerant compressor provided with an internal construction thereof for overcoming the defects encountered by the reciprocatory piston type refrigerant compressor of the prior art.

Another object of the present invention is to provide a reciprocatory piston type refrigerant compressor provided with an internal construction thereof capable of reducing pressure loss of the refrigerant gas and preventing noise generation and damage to the suction and discharge valve elements.

In accordance with one aspect of the present invention there is provided a reciprocatory piston type refrigerant compressor for compressing a refrigerant of a refrigeration system that comprises:

a compressor body including:

an open ended cylinder block provided with a central axis thereof, a cylindrical central bore formed so as to be coaxial with the central axis, and a plurality of axial cylinder bores arranged around and parallel to the central axis; and a housing means connected to axial opposite ends of the cylinder block for air-tightly closing the axial opposite ends of the cylinder block;

a low pressure chamber for the refrigerant before compression, defined in a part of the compressor body so as to receive therein the refrigerant before compression from the refrigeration system; the suction chamber being in communication with the plurality of cylinder bores via a plurality of suction ports;

a discharge chamber for the refrigerant after compression, defined in the housing means of the compressor body so as to receive therein the refrigerant after compression to be delivered toward the refrigeration system; the discharge chamber being in communication with the plurality of cylinder bores via a plurality of discharge ports;

a rotatable drive shaft having axial ends thereof rotatably supported by bearings seated in the housing means and the cylinder block of the compressor body;

a plurality of reciprocatory pistons fitted in the plurality of axial cylinder bores of the cylinder block;

each piston being reciprocated in one of the plurality of cylinder bores for suction, compression, and discharge of the refrigerant;

a swash plate-operated piston drive mechanism arranged in the compressor body around the rotatable drive shaft for driving reciprocation of the plurality of reciprocatory pistons in the plurality of cylinder bores in cooperation with the drive shaft;

a suction valve means arranged for closing the plurality of suction ports and movable so as to open the plurality of suction ports in a predetermined sequence;

a discharge valve means arranged for closing the plurality of discharge ports and movable so as to open the plurality of discharge ports in a predetermined sequence; and a first means for mechanically moving the suction valve means from the suction port closing position thereof to the suction port opening position in the predetermined sequence in synchronism with the suction stroke of respective pistons.

In accordance with another aspect of the present invention there is provided a reciprocatory piston type refrigerant compressor for compressing a refrigerant of a refrigeration system that comprises:

a compressor body including:

an open ended cylinder block provided with a central axis thereof, a cylindrical central bore formed to be coaxial with the central axis, and a plurality of axial cylinder bores arranged around and parallel to the central axis; and a housing means connected to axial opposite ends of the cylinder block for air-tightly closing the axial opposite ends of the cylinder block;

a low pressure chamber for the refrigerant before compression, defined in a part of said compressor body so as to receive therein the refrigerant before compression from the refrigeration system; the suction chamber being in communication with the plurality of cylinder bores via a plurality of suction ports;

a discharge chamber for the refrigerant after compression, defined in the housing means of the compressor body so as to receive therein the refrigerant after compression to be delivered toward the refrigeration system; the discharge chamber being in communication with the plurality of cylinder bores via a plurality of discharge ports;

a rotatable drive shaft having axial ends thereof rotatably supported by bearings seated in the housing means and the cylinder block of the compressor body;

a plurality of reciprocatory pistons fitted in the plurality of axial cylinder bores of the cylinder block;

each piston being reciprocated in one Of the plurality of cylinder bores for suction, compression, and discharge of the refrigerant;

a swash plate-operated piston drive mechanism arranged in the compressor body around the rotatable drive shaft for driving reciprocation of the plurality of reciprocatory pistons in the plurality of cylinder bores in cooperation with the drive shaft;

a suction valve means arranged for closing the plurality of suction ports and movable so as to open the plurality of suction ports in a predetermined sequence;

a discharge valve means arranged for closing the plurality of discharge ports and movable so as to open the plurality of discharge ports in a predetermined sequence; and a means for mechanically moving the discharge valve means from the discharge port closing position thereof to the discharge port opening position in the predetermined sequence in synchronism with the discharge stroke of respective pistons.

BRIEF DESCRIPTION OF THE DRAWINGS

The above and other objects, features and advantages of the present invention will be made more apparent from the ensuing description of the preferred embodiments thereof in conjunction with the accompanying drawings wherein.

DESCRIPTION OF THE PREFERRED EMBODIMENTS

Figure 1:
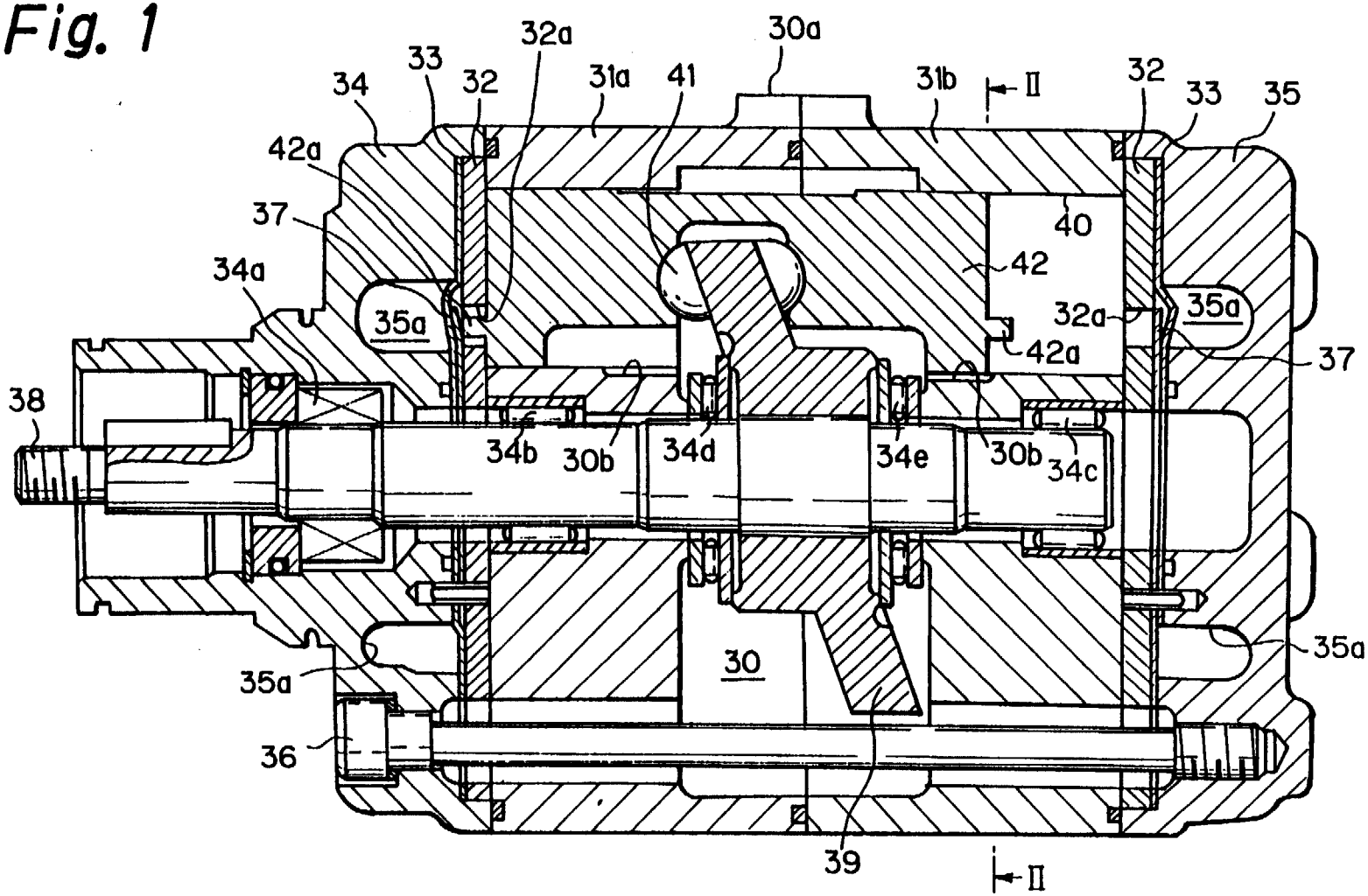
FIG. 1 is a longitudinal cross-sectional view of a reciprocatory piston type compressor according to a first embodiment of the present invention.
Figure 2:
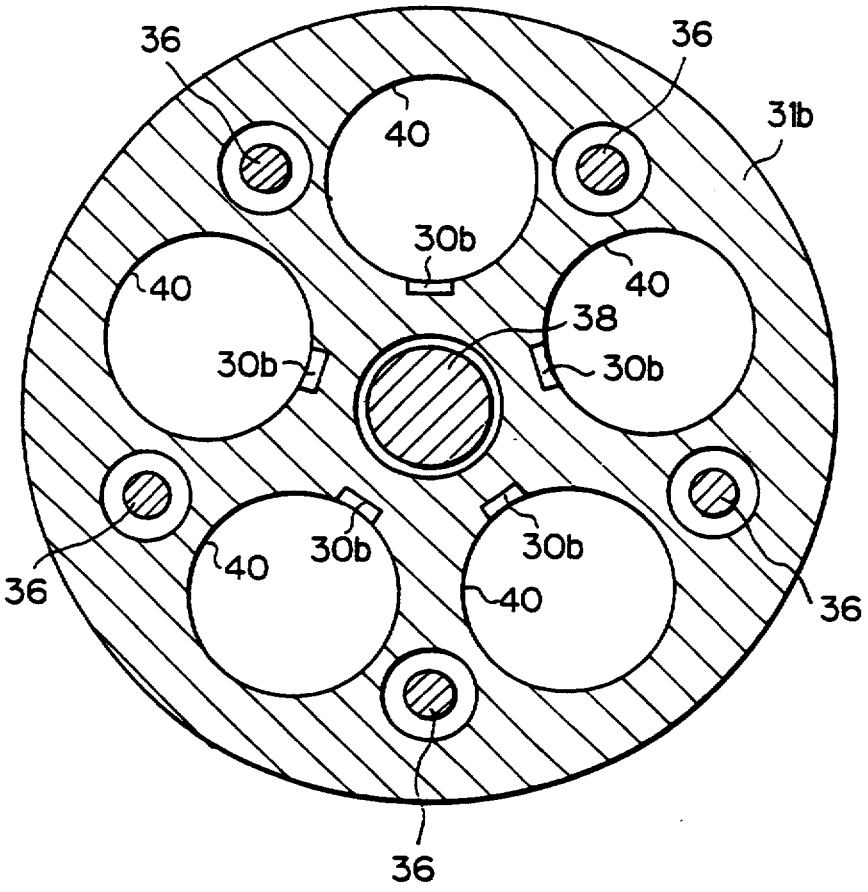
FIG. 2 is a cross-sectional view, taken along the line II—II of FIG. 1.

Referring to FIGS. 1 and 2, illustrating the first embodiment of the present invention, a reciprocatory double-headed piston type refrigerant compressor includes axially combined front and rear cylinder blocks 31*a* and 31*b* having a common central axis. The combined cylinder blocks 31*a* and 31*b* are provided with axially opposite ends, a central bore for receiving a later-described drive shaft, and a swash plate chamber 30 that is a low pressure chamber for receiving a refrigerant gas before compression.

The axial opposite ends of the combined cylinder blocks are air-tightly closed by front and rear housings 34 and 35, via a pair of valve plates 32 and a pair of retainer plates 33. Namely, the combined cylinder blocks 31*a* and 31*b*, and the front and rear housings 34 and 35 are axially combined together by a plurality of lengthy bolts 36 to define a compressor body.

A valve sheet having a plurality of later-described flapper type discharge valves 37 is arranged between the valve plate 32 and the retainer plate 33 on both front and rear sides of the compressor body.

A drive shaft 38 is rotatably supported by the front housing 34, and the combined cylinder blocks 31*a* and 31*b*, via a shaft seal element 34*a*, and front and rear radial bearings 34*b* and 34*c*. The drive shaft 38 has a portion thereof on which a swash plate 39 is mounted so as to be rotatable together in the low pressure swash plate chamber 30. The swash plate 39 is axially supported by the shoulders of the combined cylinder blocks 31*a* and 31*b*, via thrust bearings 34*d* and 34*e*. The combined front and rear cylinder blocks 31*a* and 31*b* are provided with a plurality of (five in the present embodiment) axially extended cylinder bores 40 to slidably receive double-headed pistons 42 (shown in FIG. 1 and omitted in FIG. 2), and the double-headed pistons 42 are operatively connected to the swash plate 39, respectively, via two half-spherical shoes 41 as best shown in FIG. 1. The respective front and rear valve plates 32 are provided with a plurality of (five in the present embodiment) through-bored discharge ports 32*a* formed therein, respectively, so as to be closed by the flapper type discharge valves 37 and capable of providing a fluid communication between respective cylinder bores 40 and discharge chambers 35*a* of the front and rear housings 34 and 35, in response to the opening of the discharge valves 37. Each double-headed piston 42 is provided with axially oppositely extended protrusions 42*a* on the opposite ends thereof so as to be capable of coming into and out of the discharge ports 32*a* of the front and rear valve plates 32 when the piston 42 reciprocates. Namely, each protrusion 42*a* of the piston 42 has a diameter smaller than that of the discharge port 32*a* and an axial length longer than the depth of the discharge port 32*a*.

The combined cylinder blocks 31*a* and 31*b* of the compressor body are provided with a suction inlet 30*a* opening toward the swash plate chamber 30 for introducing the refrigerant gas into the swash plate chamber 30 from the external refrigeration system. The refrigerant gas compressed in the cylinder bores 40 by the double-headed reciprocatory pistons 42 is discharged from the cylinder bores 40 toward the discharge chambers 35*a* of the front and rear housings 34 and 35, via the discharge ports 32*a*, and is delivered therefrom toward the external refrigeration system, via a delivery outlet (not shown in FIGS. 1 and 2).

The combined cylinder blocks 31*a* and 31*b* are provided with a plurality of axial recesses (five on each of the front and rear sides) which act as suction ports 30*b* between the low pressure swash plate chamber 30 and respective cylinder bores 40. It should be noted that the suction ports 30*b* are arranged adjacent to respective cylinder bores 40 in such a manner that when each head of the double-headed piston 42 approaches the bottom dead center of the piston 42 in the corresponding cylinder bore 40, the swash plate chamber 30 is fluidly communicated with the corresponding cylinder bore 40, via the recess 30*b*, as clearly shown in FIG. 1. More specifically, when the swash plate chamber 30 is fluidly communicated with respective cylinder bores 40 for a given time period, via the suction ports 30*b*, in response to the approach of the double-headed pistons 42 to the bottom dead center thereof, the refrigerant gas before compression is sequentially supplied from the swash plate chamber 30 into respective cylinder bores 40. Therefore, the axially opposite head portions of respective double-headed pistons 42 operate as suction valves to close and open the suction ports 30*b* during the reciprocation thereof in the cylinder bores 40, and accordingly, the suction of the refrigerant gas from the low pressure swash plate chamber 30 into respective cylinder bores 40 can be carried out in synchronism with the suction stroke of the pistons 42 without time delay and noise.

The double-headed pistons 42 compress the refrigerant gas in the corresponding cylinder bores 40, and the compressed refrigerant gas is discharged from the cylinder bores 40 toward the front and rear discharge ports 32*a* when the respective heads of the pistons 42 approach the top dead center thereof. Namely, when the respective heads of the pistons 42 are moved to the top dead center thereof, the protrusions 42*a* come into the discharge ports 32*a* and forcibly urge the flapper type discharge valves 37 to move to the opening position thereof limited by the retainer plate 33, and therefore, the compressed refrigerant gas is discharged toward the discharge chamber 35*a* via air gaps in the opened discharge ports 32*a* (see the front side of FIG. 1). Thus, due to the forcible opening of the discharge valves 37 by the protrusions 42*a* of the pistons 42, the compressed refrigerant gas can be discharged from the cylinder bores 40 toward the discharge chambers 35*a*, and delivered from the discharge chambers 35*a* toward the external refrigeration system irrespective of the pressure level in the cylinder bores 40. Namely, the delivery of the compressed gas can be carried out in synchronism with the discharge stroke of the pistons 42 without a time delay. Naturally, the flapper type discharge valves 37 smoothly return to the closing position thereof closing the discharge ports 32*a* together with the engaged protrusions 42*a* of the pistons 42 in response to movement of the pistons 42 from the top dead center toward the bottom dead center, and accordingly noise is lowered significantly.

The shown swash plate type refrigerant compressor having double-headed reciprocatory pistons is therefore able to achieve compression of the refrigerant gas of the refrigeration system with a high volumetric efficiency and minimal loss of pressure. Further, even when the compressor is operated either at a high load or a high speed, the level of noise can be lowered, and damage to the elements and components can be avoided.

Moreover, in the described double-headed piston type compressor, the front and rear housings 34 and 35 of the compressor body are not-provided with suction chambers, and the low pressure swash plate chamber acts as a suction chamber, and accordingly, the overall size and the weight of the compressor body can be appreciably reduced compared to the conventional double-headed piston type compressor.

Figure 3:
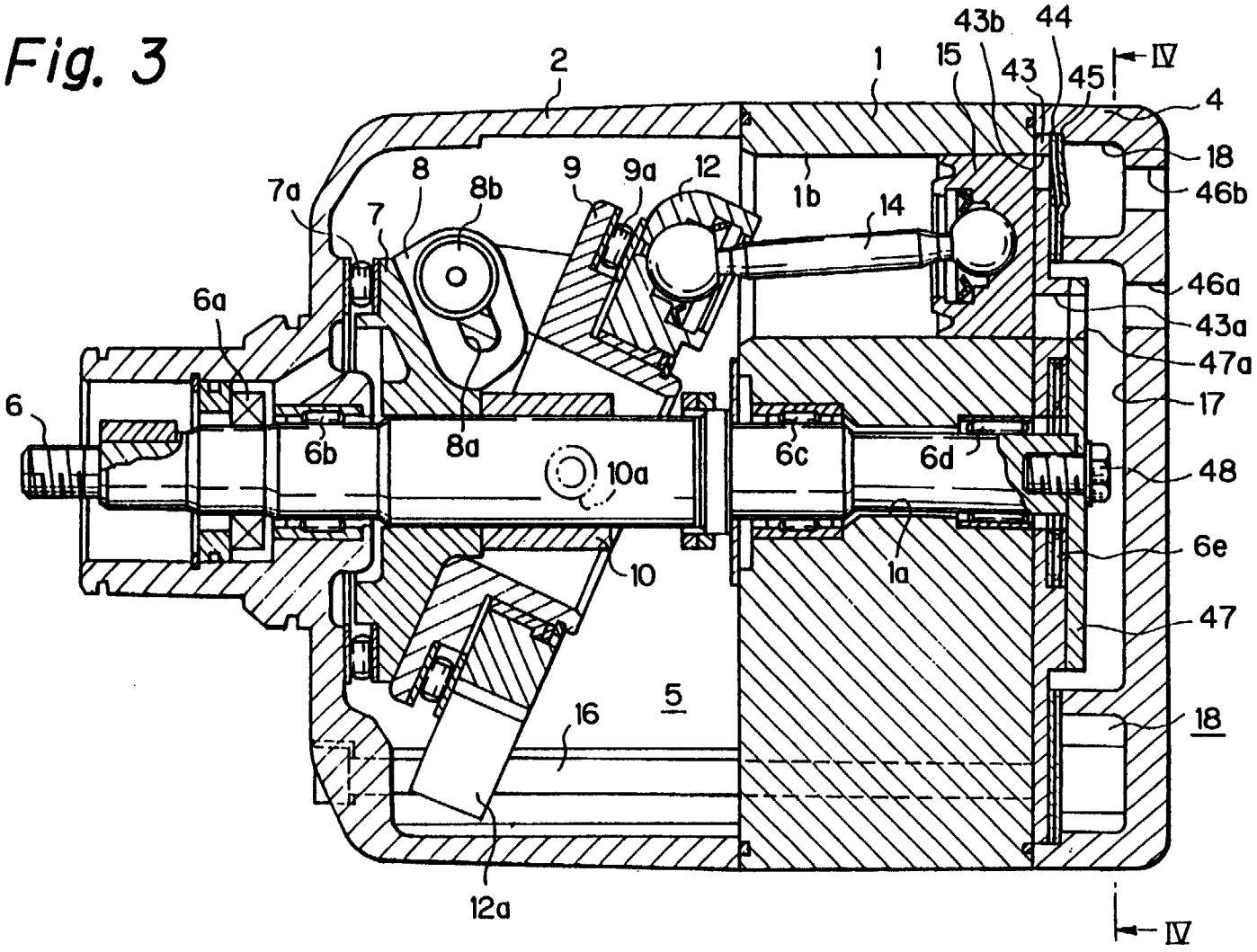
FIG. 3 is a longitudinal cross-sectional view of a reciprocatory piston type refrigerant compressor according to a second embodiment of the present invention.
Figure 4:
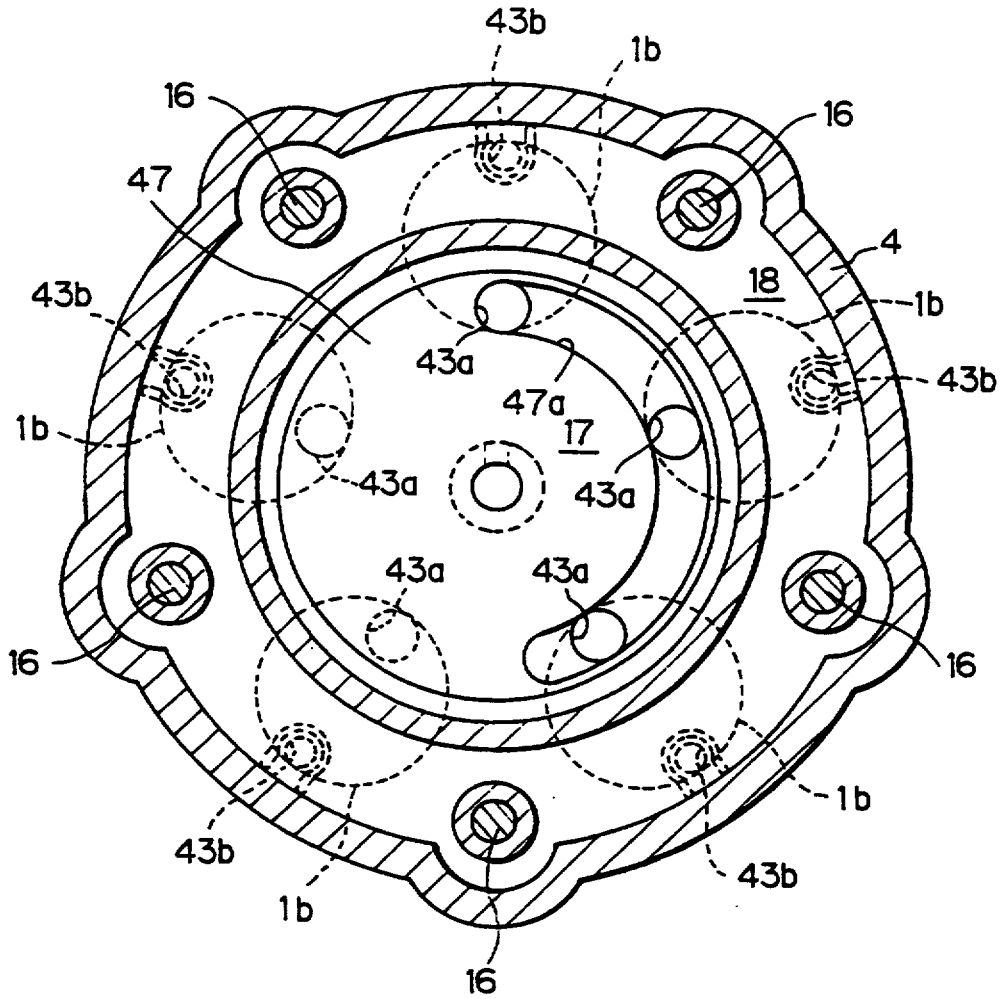
FIG. 4 is a cross-sectional view, taken along the line IV—IV of FIG. 3.

Referring to FIGS. 3 and 4 illustrating the second embodiment of the present invention, a reciprocatory piston type variable capacity refrigerant compressor includes a cylinder block 1 having a central axis. The cylinder block 1 is provided with axially opposite ends, a central bore 1*a* extended coaxially with the central axis for receiving a drive shaft 6, and a plurality of (e.g., five in the embodiment) cylinder bores 1*b* arranged equiangularly around and parallel to the central axis. One of the axial ends, i.e., a front end of the cylinder block 1 is air-tightly closed by a front housing 2, and the other end, i.e., a rear end of the cylinder block 1 is air-tightly closed by a rear housing 4 via a valve plate 43, a discharge valve sheet 44, and a retainer 45. The cylinder block 1, the front housing 2, and the rear housing 4 are axially combined by a plurality of long bolts 16 so as to define a compressor body.

The front housing 2 of the compressor body defines a crank chamber 5 axially extending in front of the front end of the cylinder block 1. The rear housing 4 of the compressor body defines therein a radially internally arranged cylindrical suction chamber 17 for a refrigerant before compression, and an annularly extending outer discharge chamber 18 for a refrigerant after compression, arranged so as to surround and be isolated from the internal suction chamber 17.

The drive shaft 6 axially extending through the crank chamber 5 is rotatably supported by bearings 6*b* and 6*c* seated in a central bore of the front housing 2 and the central bore 1*a* of the cylinder block 1, and a front end portion of the drive shaft 6 is sealed by a shaft seal element 6*a* from the exterior of the front housing 2. The drive shaft 6 has a rotor 7 fixedly mounted thereon to be rotated together and axially supported by a thrust bearing 7*a* arranged between an inner end of the front housing 2 and the frontmost end of the rotor 7. The rotor 7 has a support arm 8 extending from a rear part thereof so as to provide an extension in which an elongated through-bore 8*a* is formed for receiving a lateral pin 8*b* slidably movable in the through-bore 8*a*. The lateral pin 8*b* is connected to a swash plate 9 arranged around the drive shaft 6 and is capable of changing the angle of inclination thereof with respect to a plane perpendicular to the rotating axis of the drive shaft 6.

A sleeve element 10 axially and slidably mounted on the drive shaft 6 is arranged adjacent to the rearmost end of the rotor 7, and is constantly urged toward the rearmost end of the rotor 7 by a coil spring (not shown in FIGS. 3 and 4) arranged around the drive shaft 6 at a rear portion thereof. The sleeve element 10 has a pair of laterally extending trunnion pins 10*a* on which the swash plate 9 is pivoted so as to be moved thereabout, thereby changing the angle of inclination with respect to a plane vertical to the axis of the drive shaft 6.

The swash plate has an annular rear face and a cylindrical flange to support thereon a non-rotatable wobble plate 12 via a thrust bearing 9*a*. The non-rotatable wobble plate 12 has an outer periphery provided with a guide portion 12*a* in which one of the long bolts 16 is fitted to prevent any rotational play of the wobble plate 12 on the swash plate 9, and the wobble plate 12 is operatively connected to pistons 15 axially and slidably fitted in the cylinder bores 1*b*, via connecting rods 14.

When the drive shaft 6 is rotated together with the rotor 7 and the swash plate 9, the wobble plate 12 on the swash plate 9 is non-rotatably wobbled, thereby causing reciprocation of respective pistons 15 in the cylinder bores 1*b*. In response to the reciprocation of the pistons 15, the refrigerant is drawn from the suction chamber 17 into respective cylinder bores 1*b* and compressed therein. The compressed refrigerant is discharged from respective cylinder bores 1*b* toward the discharge chamber 18, from which the refrigerant after compression is delivered to an external refrigeration system.

During the operation of the compressor, when a change in a pressure differential appears between a suction pressure in each cylinder bore 1*b* and a pressure prevailing in the crank chamber 5, the stroke of each piston 15 is changed, and therefore, the angle of inclination of the swash plate 9 and the wobble plate 12 is changed. The pressure in the crank chamber 5 is adjustably changed by a conventional solenoid control valve (not shown in FIG. 3) housed in an appropriate portion of the rear housing 4.

The afore-mentioned cylindrical inner suction chamber 17 of the rear housing 4 has a suction inlet 46*a* formed in a flat end wall of the rear housing 4 so that the suction chamber 17 is capable of receiving a refrigerant gas therein when the refrigerant gas returns from the exterior refrigeration system.

The annular discharge chamber 18 of the rear housing 4 has a delivery outlet 46*b* formed in the peripheral portion of the end wall of the rear housing 4 so that the refrigerant gas after compression may be delivered from the discharge chamber 18 toward the external refrigerating system via the delivery outlet 46*b*.

A plurality of suction ports 43*a* (the number usually corresponds to that of the cylinder bores 1*b*) are provided for communicating the suction chamber 17 with respective cylinder bores 1*b*. The suction ports 43*a* are formed as equiangularly arranged axial through-bores piercing the valve plate 43, and are concentric with the afore-mentioned central axis of the cylinder block 1, as best shown in FIG. 4. Therefore, the refrigerant gas introduced in the suction chamber 17 via the suction inlet 46*a* is drawn into respective cylinder bores 1*b* via respective suction ports 43*a* when the reciprocatory pistons 15 carry out the suction stroke thereof moving toward the bottom dead center in respective cylinder bores 1*b*. When the refrigerant gas is drawn in the cylinder bores 1*b*, a plate-like rotary valve element 47 opens the suction ports 43*a* so as to provide a fluid communication between the suction chamber 17 and the cylinder bores 1*b*. Namely, the rotary valve element 47 is connected by a screw bolt 48 to the rearmost end of the drive shaft 6 under the support of a radial bearing 6*d* and a thrust bearing 6*e* so that it is rotated together with the drive shaft 6. The rotary valve element 47 is provided with a suction passageway 47*a* consisting of a circularly elongated aperture as best shown in FIG. 4. Thus, during the rotation of the rotary valve element 47, the suction passageway 47*a* is moved along a predetermined circle coaxial with the circle on which the suction ports 43*a* of the valve plate 43 are arranged. Therefore, when the rotary valve element 47 is rotated, a predetermined number of suction ports 43*a* (e.g., three suction ports in the shown embodiment) are uncovered by the circular suction passageway 47*a* of the rotary valve element 47, and accordingly, the suction ports 43*a* and the suction passageway 47*a* provide a fluid communication between the corresponding cylinder bores 1*b* and the suction chamber 17. As a result, the refrigerant gas is introduced from the suction chamber 17 into the cylinder bores 1*b*.

A plurality of discharge ports 43*b* (the number usually corresponds to that of the cylinder bores 1*b*) are provided for communicating respective cylinder bores 1*b* with the annular discharge chamber 18. The discharge ports 43*b* are formed as equiangularly arranged axial through-bores piercing the outer periphery of the valve plate 43. Thus, when the pistons 15 carry out the compression and discharge strokes thereof moving toward the top dead center thereof in-the respective cylinder bores 1*b*, the compressed refrigerant gas is discharged from the cylinder bores 1*b* toward the discharge chamber 18 via the discharge ports 43*b*. When the refrigerant gas is discharged from the cylinder bores 1b, flapper type discharge valves of the discharge valve sheet 44 are forcedly moved to the opening positions thereof and are limited by the retainer 45 (FIG. 3).

From the above description of the second embodiment of FIGS. 3 and 4, it will be understood that when the plate-like rotary valve element 47 is rotated in synchronism with the drive shaft 6, the cylinder bores 1b in which the corresponding pistons 15 carry out the suction stroke thereof are communicated with the suction chamber 17 via the suction ports 43a and the suction passageway 47a for a given period of time depending on the circumferential length of the suction passageway 47a and the speed of the rotation of the rotary valve element 47. Therefore, the refrigerant gas is drawn from the suction chamber 17 into the communicated cylinder bores 1b. Since the plate-like valve element 47 is capable of mechanically opening the suction ports 43a of respective cylinder bores 1b in synchronism with the suction stroke of the pistons 15, the suction of the refrigerant gas from the suction chamber 17 into the cylinder bores 1b is carried out without a time delay from the moment that the suction ports 43a are opened. Accordingly, the compressor of the second embodiment can be operated at high volumetric efficiency with low pressure loss. Further, it is possible to reduce the generation of noise and prevent damage to the elements and components thereof even when the compressor is operated either under a high load or at a high speed.

The second embodiment of FIGS. 3 and 4, in which the plate-like rotary valve element 47 having the suction passageway 47a is operated in synchronism with the suction stroke of the pistons 15 by fixedly connecting the valve element 47 to the rearmost end of the drive shaft 6, may be varied in such a manner that the synchronized opening of the suction ports 43a by the valve element 47 may be obtained by rotating the valve element 47 by an electric motor electrically operated by an electric drive circuit. The electric drive circuit may be controlled by a well known microcomputer that generates drive command signals to be given to the drive circuit in response to synchronizing signals received from a synchronization detection means that detects e.g., the rotation of the drive shaft 6. Namely, the synchronization detection means may include a permanent magnet attached to the drive shaft 6 and a solenoid electrically connected to the microcomputer and cooperating with the permanent magnet so as to generate an electric signal indicating the rotation of the drive shaft 6 and supplied to the micro, computer.

Figure 5:
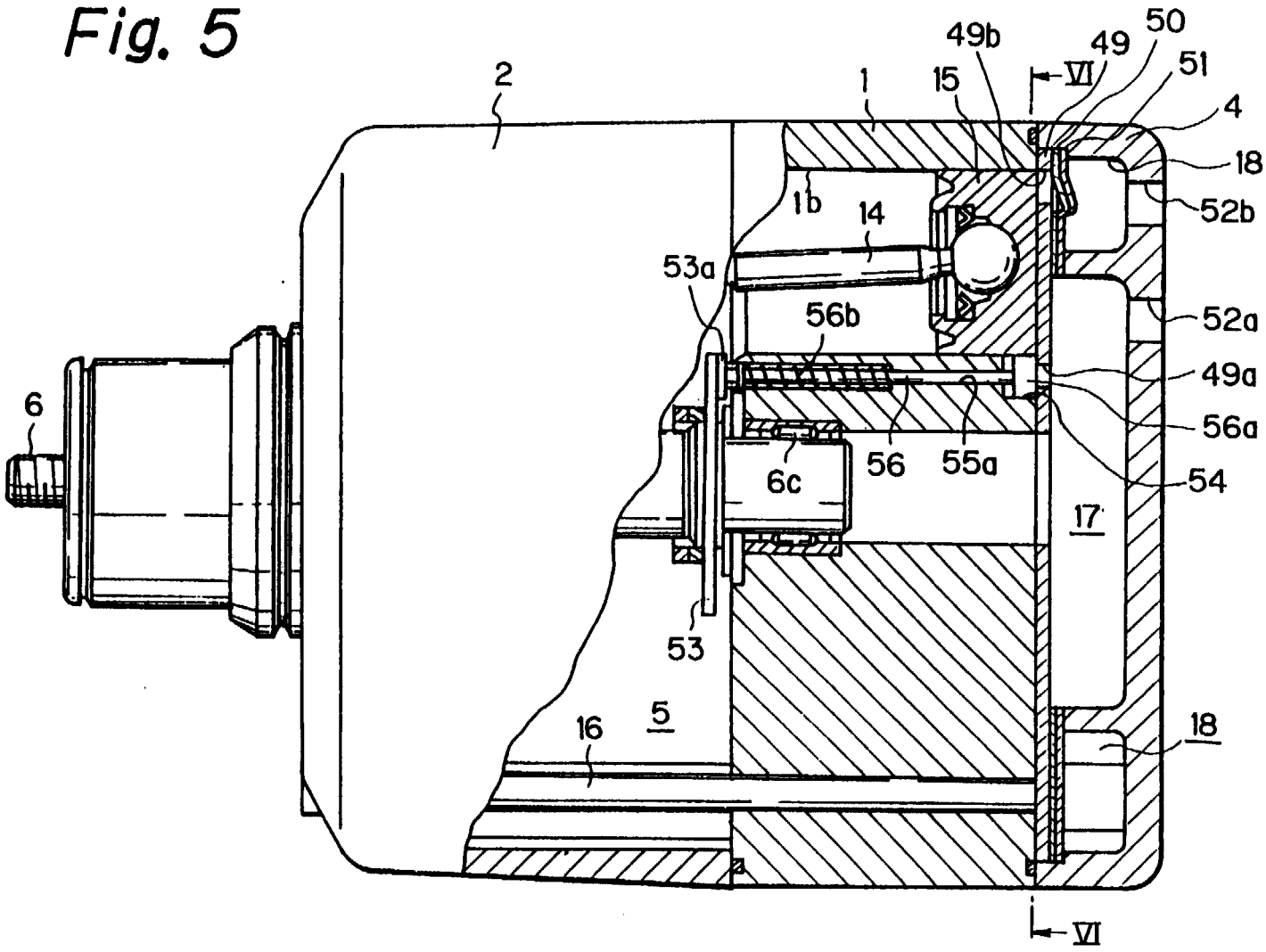
FIG. 5 is a side view, in partial cross-section, of a reciprocatory piston type refrigerant compressor according to a third embodiment of the present invention.
Figure 6:
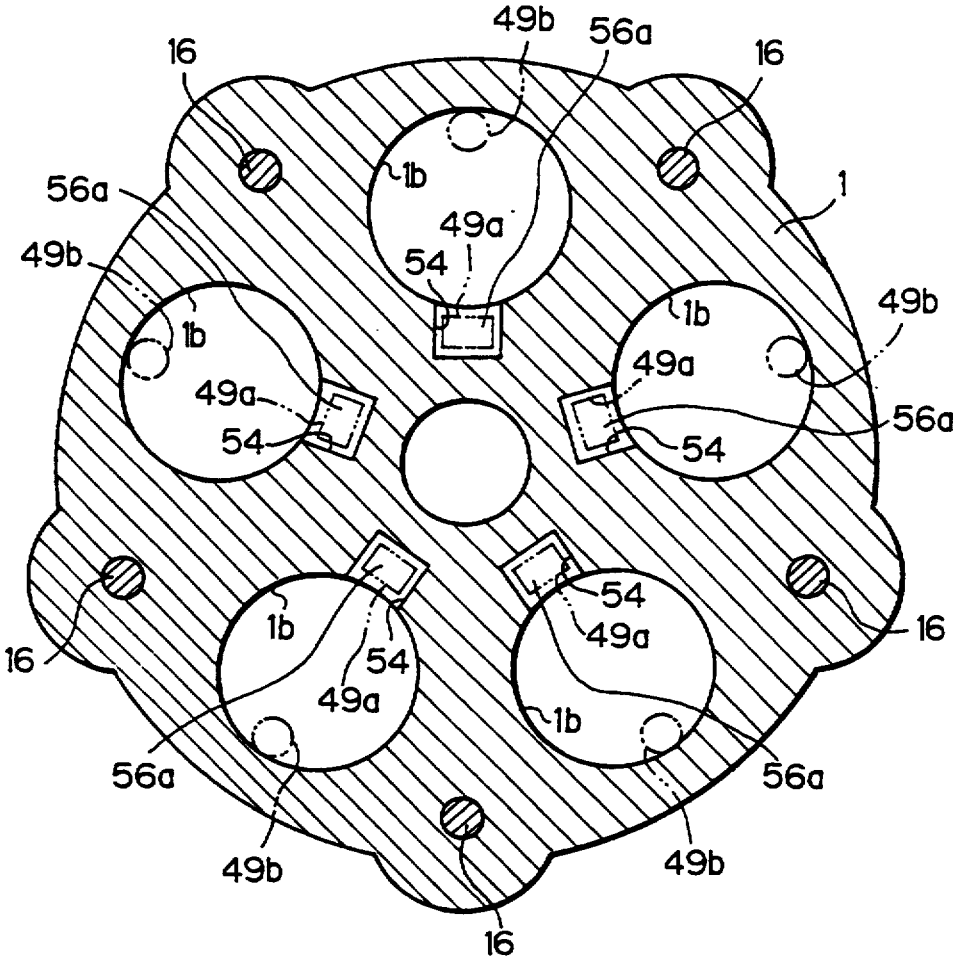
FIG. 6 is a cross-sectional view, taken along the line VI—VI of FIG. 5.
Figure 7:
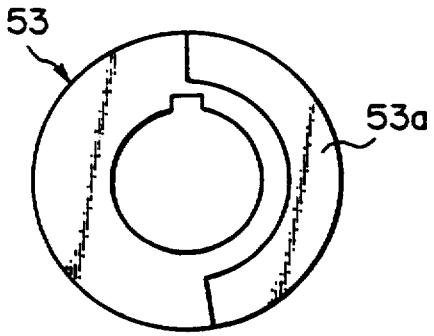
FIG. 7 is a plan view of a rotary valve element accommodated in the compressor of the third embodiment.

FIGS. 5 through 7 illustrate a variable capacity type reciprocatory piston type compressor according to the third embodiment of the present invention. It should be understood that the compressor of the third embodiment has many similarities in construction thereof to that of the second embodiment, and therefore elements and parts of the compressor, designated by the same reference numerals as those of the second embodiment of FIGS. 3 and 4 may be understood as the same elements and parts, although no particular description of the construction and operation is provided below.

Referring to FIGS. 5 through 7, the rear end of the cylinder block 1 is closed by the rear housing 4 via a flat valve plate 49, a discharge valve sheet 50 having flapper type discharge valves, and a retainer plate 51.

A plurality of long bolts 16 (e.g., five in the third embodiment) are arranged to combine the cylinder block 1, and the front and rear housings 2 and 4 together thereby defining a compressor body. The rear housing 4 is provided with the radially inner suction chamber 17 as a low pressure chamber and the annular discharge chamber 18 arranged radially outside the suction chamber 17. The suction chamber 17 has a suction inlet 52a through which the refrigerant gas is introduced into the suction chamber 17 from the external refrigeration system to which the discharge chamber 18 is connected via a delivery outlet 52b.

In the crank chamber 5 defined by the front housing 2, a cam element 53 as best shown in FIG. 7 is mounted on the drive shaft 6, and a plurality of suction ports 49a are provided in the valve plate 49 at positions adjacent to respective cylinder bores 1b, and are communicated with a plurality of valve chambers 54 formed in the rear end of the cylinder block 1.

The cylinder block 1 is provided with a plurality of axial through-holes 55a extending frontward from respective valve chambers 54 so as to open toward the crank chamber 5. The through-holes 55a receive therein axial rods 56 having a valve element 56a, respectively, which operates to open and close the suction ports 49a of the valve plate 49 within respective valve chambers 54. The rods 56 are constantly urged by coil spring elements 56b toward the frontmost position thereof, respectively. The frontmost end of each of the rods 56 is in contact with the face of the cam element 53. The cam element 53 is provided with a ridge 53a circularly extended for a predetermined angle about the center of the cam element 53 and raised from the rear face of the cam element 53 as shown in FIG. 7. The ridge 53a of the cam element 53 operates so as to push the rods 56 in the rearward direction, thereby urging the valve elements 56a to be moved to positions closing the suction ports 49a.

The valve plate 49 is provided with a plurality of discharge ports 49b formed therein in the outer periphery of the valve plate 49. Therefore, when the pistons 15 carry out the compression and discharge strokes thereof in the corresponding cylinder bores 1b approaching the top dead center thereof, the compressed gas urges the discharge valves of the discharge valve sheet 50 toward the opening position thereof limited by the retainer plate 51, and is discharged toward the discharge chamber 18 via the discharge ports 49b.

In the described third embodiment of FIGS. 5 through 7, the suction valves including the axial rods 56, the valve elements 56a, and the coil springs 56b are mechanically opened by the cam element 53 for a given time period determined by the circular length of the ridge 53a of the cam element 53. Thus, respective cylinder bores 1b and the suction chamber 17 are fluidly communicated with one another via the suction ports 49a for the given time period, and accordingly the refrigerant gas before compression is drawn from the suction chamber 17 into respective cylinder bores 1b by a predetermined sequence immediately in response to the opening of the suction ports 49a without a time delay. Accordingly, the compressor of the third embodiment can operate under a small pressure loss and at a high volumetric efficiency. Further, the operation of the compressor is free of noise and damage even when the compressor is operated either under a high load or a high speed.

Figure 8:
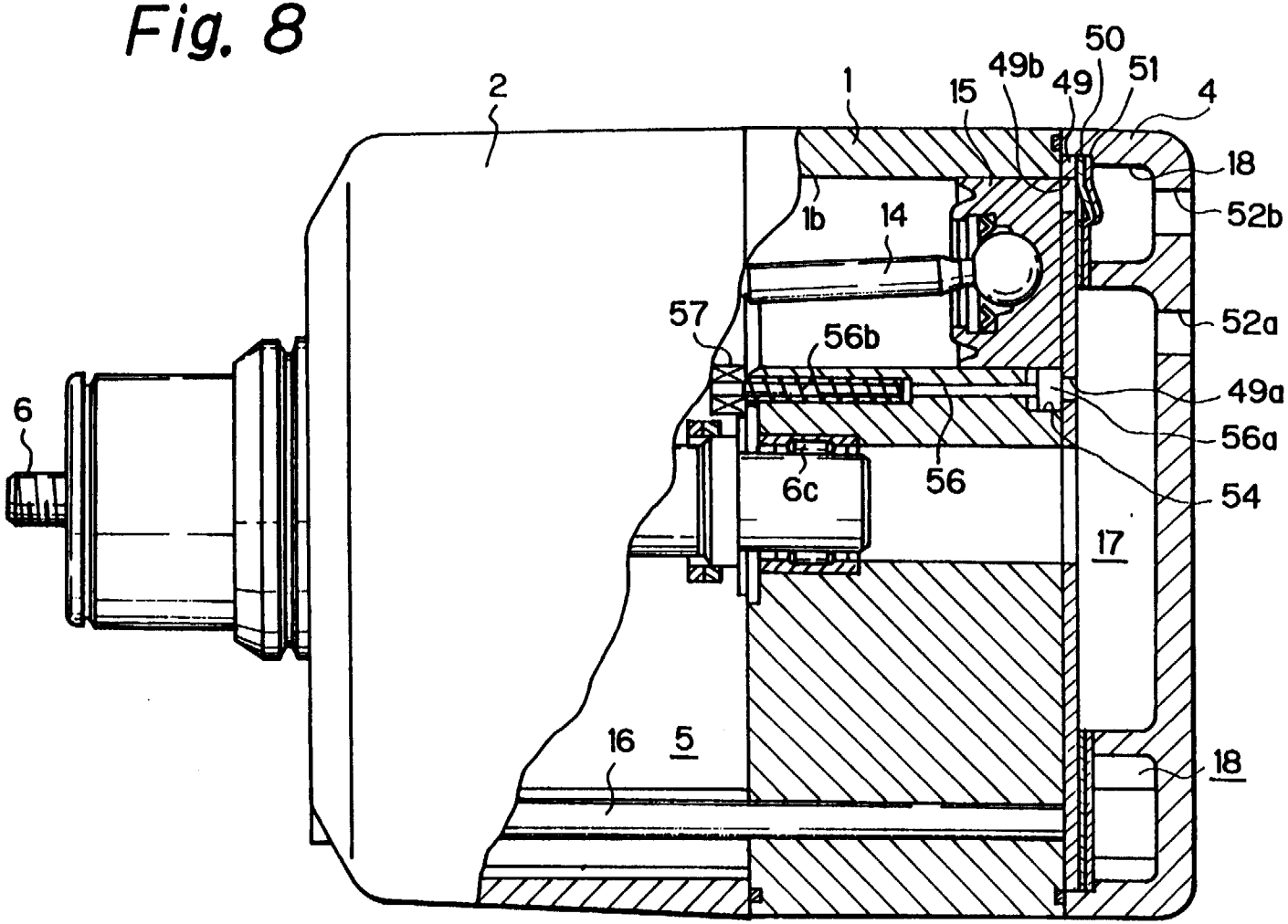
FIG. 8 is a side view, in partial cross-section, of a reciprocatory piston type refrigerant compressor, illustrating a constructional variation from the third embodiment of FIG. 5.

The reciprocatory piston type compressor of the third embodiment of FIGS. 5 through 7, in which the opening of the suction ports 49a of respective cylinder bores 1b is mechanically synchronized with the suction stroke of the reciprocatory pistons 15 by the employment of the cam-operated rod-like suction valve means, may be varied in such a manner that the rod-like suction valve means is electromagnetically synchronized with the suction stroke of the pistons 15 via the rotary drive shaft 6 as shown in FIG. 8.

In FIG. 8, the rotary drive shaft 6 has a permanent magnet (not shown) attached thereto at a portion adjacent to the inner end of the cylinder block 1 so that the permanent magnet is rotated together with the drive shaft 6. Further, an electrical coil is arranged at an appropriate position adjacent to the permanent magnet so as to cooperate with the permanent magnet rotating together with the drive shaft 6.

A solenoid 57 is attached to the frontmost end of each rod 56 having the valve element 56*a* at the rearmost end constantly urged by a coil spring 56*b* toward a position closing the corresponding suction port 49*a*. The aforementioned electrical coil electromagnetically cooperates with the rotating permanent magnet to generate signals indicating the rotation of the drive shaft 6, i.e., synchronization signals, and is electrically connected to a known microcomputer which imparts drive command signals to the drive circuit for the solenoid 57 in response to the above-mentioned synchronization signals. Thus, the solenoid 57, when driven or energized, magnetically attracts the rod 56 and the valve element 56*a* toward the frontward direction and against the biasing force of the coil spring 56*b* so as to open the suction port 49*a* in synchronism with the suction stroke of the piston 15, via the drive shaft 6.

The compressor of FIG. 8 can operate so as to exhibit the same operational effects and advantages of the present invention as those of the compressor of FIGS. 5 through 7.

Figure 9:
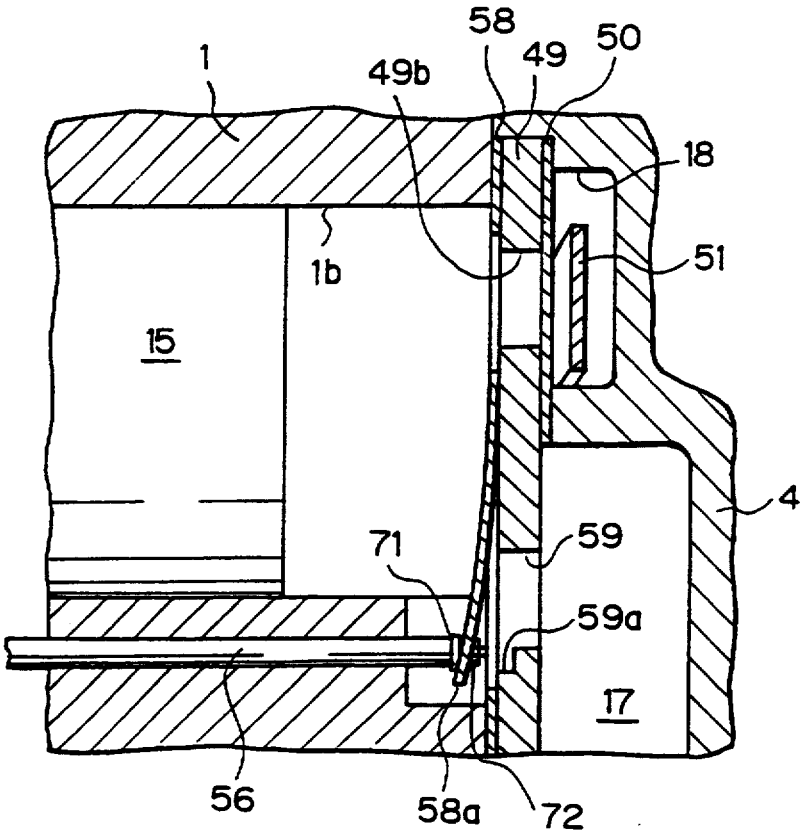
FIG. 9 is a partial cross-sectional view of a reciprocatory piston type refrigerant compressor, illustrating another constructional variation from the third embodiment of FIG. 5.

The reciprocatory piston type compressor of the third embodiment of FIGS. 5 through 7 and the variation of FIG. 8 may take a modified construction as shown in FIG. 9.

In the compressor of FIG. 9, a suction valve sheet 58 having a plurality of flapper type suction valves 58*a* is arranged between the valve plate 49 and the rear end of the cylinder block 1, and each flapper type suction valve 58*a* is held by the rear threaded end of the rod 56 via a rubber bush 71 and a screw nut 72. Thus, the flapper type suction valves 58*a* are forcibly moved by the rod 56 toward and away from a position closing the suction port 59 of the valve plate 49. The screw nut 72 is received in a recess 59*a* formed in a portion of the suction port 59 of the valve plate 49.

The suction valve sheet 58 is provided with a plurality of through-holes formed so as to be in registration with the discharge ports 49*b* of the valve plate 49.

It should be understood that the other construction of the compressor of FIG. 9 is the same as that of the third embodiment of FIGS. 5 through 7. Therefore, the compressor of FIG. 9 can exhibit the same advantageous effects as the compressor of FIGS. 5 through 7.

Figure 10:
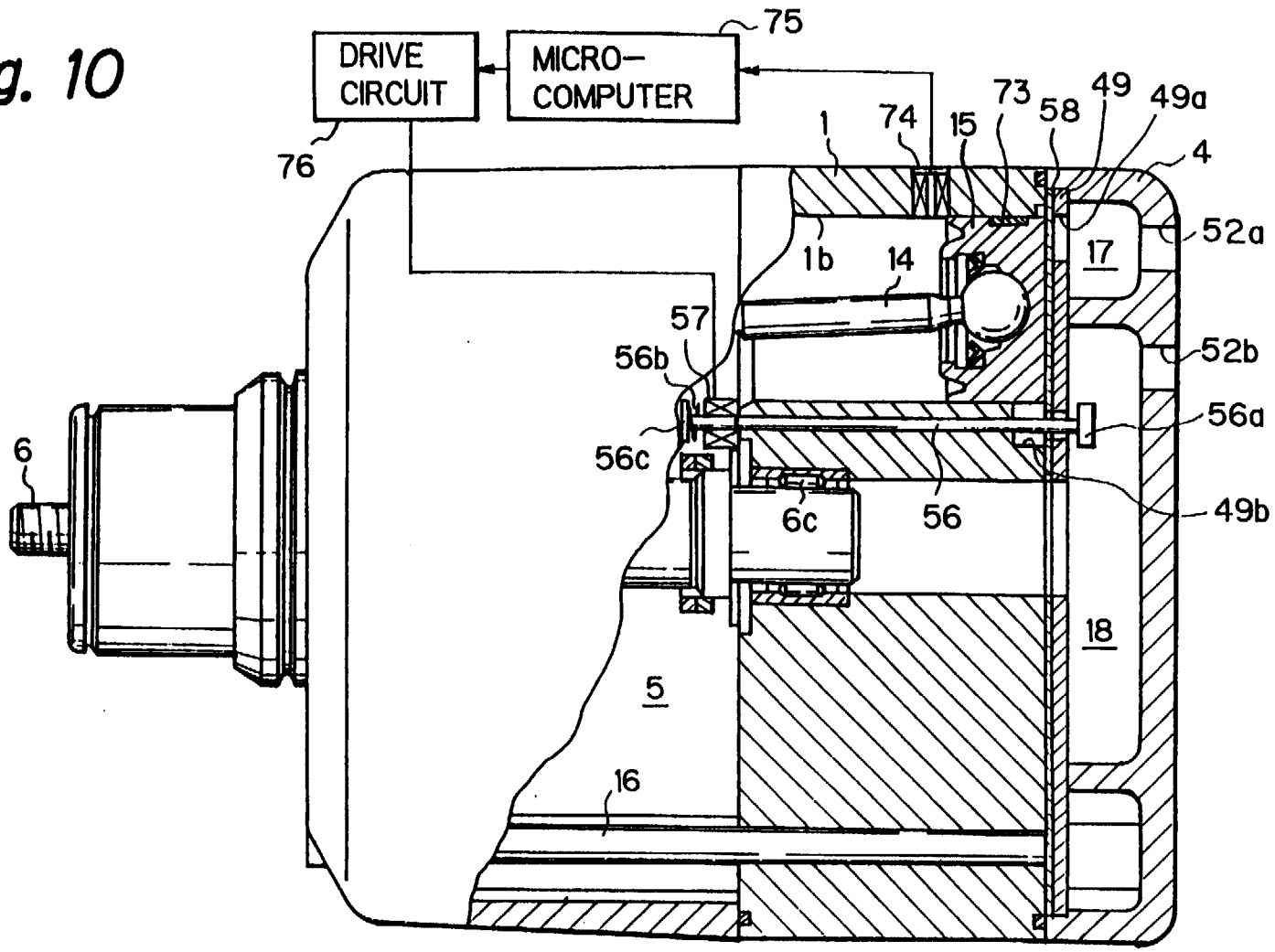
FIG. 10 is a side view, in partial cross-section, of a reciprocatory piston type compressor, illustrating a still further constructional variation from the embodiment of FIG. 5.

FIG. 10 illustrates a reciprocatory piston type compressor according to a further variation of the compressor of the third embodiment. Namely, in FIG. 10, a plurality of rod-like valve means are employed as a discharge valve for mechanically closing and opening discharge port of respective cylinder bores of the compressor in synchronism with the compression and discharge strokes of the reciprocatory pistons.

In FIG. 10, each of the reciprocatory pistons 15 is provided with a permanent magnet 73 embedded therein and an electromagnetically inductive coil 74 cooperative with the permanent magnet 73 is arranged at an appropriate position of the corresponding cylinder bore 1*b* so as to be electrically connected to the known microcomputer 75. Thus, the permanent magnet 73, the coil 74, and the microcomputer 75 function as a synchronization signal detecting means. The microcomputer 75 is electrically connected to a drive circuit 76 that is connected to the solenoid 57 attached to the frontmost end of the rod 56.

The rear housing 4 is provided with a radially outer suction chamber 17 having a suction inlet 52*a* and a radially inner discharge chamber 18 having a delivery outlet 52*b*. The valve plate 49 is provided with a plurality of suction ports 49*a* closed by a plurality of flapper type suction valves of a suction valve sheet 58. A plurality of discharge ports 49*b* are formed in the valve plate 49, the suction valve sheet 58, and the rear end of the cylinder block 1 so as to communicate with the discharge chamber 18 when a plurality of valve elements 56*a* are attached to the rearmost end of the rods 56. The frontmost end of each rod 56 is provided with an iron core 56*c*, and the rod 56 per se is constantly urged by a coil spring 56*b* toward the frontward direction, i.e., the valve elements 56*a* of the rods 56 are constantly positioned at the closing position, thereby closing the discharge ports 49*b*. When the solenoid 57 arranged adjacent,to the front end of each rod 56 is energized, the iron core 56*c* of the rod 56 is magnetically attracted toward the solenoid 57 against the spring force of the coil spring 56*b*. Thus, the rod 56 and the discharge valve element 56*a* are moved to a position opening the discharge port 49*b*. Namely, the drive circuit 76 and the solenoid 57 act as a discharge valve drive means.

In the compressor of FIG. 10, the discharge ports 49*b* of respective cylinder bores 1*b*, in which the pistons 15 are at the discharge stroke thereof, communicate with the discharge chamber 18 for a predetermined time period, and accordingly, the compressed refrigerant gas is discharged from respective cylinder bores 1*b* toward the discharge chamber 18 without a time delay due to the mechanical movement of the rod-like discharge valves 56*a* in synchronism with the discharge stroke of the pistons 15. Namely, the discharge of the compressed refrigerant gas is carried out for certain in response to the discharge stroke of the reciprocatory pistons 15 irrespective of the pressure level in the cylinder bores 1*b*. Accordingly, the compressor can exhibit a compression operation under a small pressure loss and at a high volumetric efficiency. Naturally, even when the compressor is operated either at a high load or at a high speed, the pressure loss can be as small as possible, and the operation of the compressor can be free of noise that occurs when the conventional flapper type valves strike against the valve plate, and damage to the elements and components of the compressor can be prevented.

The rod-like discharge valves 56*a* of the compressor of FIG. 10 may be modified in such a manner that the axial movement of the rod 56 having the discharge valves 56*a* is mechanically and forcibly operated by a cam element similar to the cam element 53 employed by the rod-like suction valves of the compressor of FIGS. 5 through 7.

In a further variation, the solenoid-operated rod-like discharge valve means 56*a* of FIG. 10 may be used in combination with the solenoid-operated rod-like suction valve means of he compressor as shown e.g., in FIGS. 8 and 9. As a result, it is possible to eliminate the problem of a time delay in the suction of the refrigerant gas before compression as well as in the discharge of the compressed refrigerant gas.

FIGS. 11 through 14 illustrate a reciprocatory piston type refrigerant compressor according to the fourth embodiment of the present invention. It is noted that, throughout FIGS. 11 through 14, the same reference numerals as those used in the second embodiment of FIGS. 3 and 4 designate the same or like parts and elements as those of the second embodiment.

Referring to FIGS. 11 through 14, the reciprocatory piston type refrigerant compressor includes a cylinder block 1 provided with axially opposite flat ends, and a centrally and axially formed bore 1*a* having various diameter portions about a common central axis. The rearmost portion of the central bore 1*a* of the cylinder block 1 is formed as a cylindrical chamber for rotatably receiving a rotary valve 22, and the middle portion of the central bore 1*a* of the cylinder block 1 receives a rotary bearing 6*c* rotatably supporting an end of a drive shaft 6.

The cylinder block 1 is further provided with a plurality of (e.g., five in this embodiment) cylinder bores 1*b* arranged equiangularly around and parallel to the central axis. One of the axial ends, i.e., a front end of the cylinder block 1, is air-tightly closed by a front housing 2, and the other end, i.e., a rear end of the cylinder block 1, is air-tightly closed by a rear housing 4 via a partition plate or a valve plate 3, a discharge valve sheet 18*b*, and a retainer plate 20. The front housing 2, the cylinder block 1, and the rear housing 4 are axially combined together by a plurality of bolts 16, thereby defining a compressor body.

The front housing 2 defines a crank chamber 5 therein axially extending in front of the front end of the cylinder block 1. The rear housing 4 defines therein a centrally arranged cylindrical suction chamber 17 (a low pressure chamber) for a refrigerant before compression, and an annularly extending discharge chamber 18 for a refrigerant after compression arranged so as to surround and be isolated from the suction chamber 17.

The drive shaft 6 axially extending through the crank chamber 5 is rotatably supported by bearings 6*b* seated in a central bore of the front housing 2 and bearing 6*c* seated in the middle portion of the central bore 1*a* of the cylinder block 1, and the outer end portion of the drive shaft 6 is sealed by a shaft seal 6*a* against the exterior of the compressor body.

The drive shaft 6 has a rotor 7 fixedly mounted thereon so as to be rotated together and axially supported by a thrust bearing 7*a* arranged between an inner end of the front housing 2 and the frontmost end of the rotor 7. The rotor 7 has a support arm 8 extending from a rear part thereof so as to provide an extension in which an elongated through-bore 8*a* is formed for receiving a lateral pin 8*b* slidably movable in the through-bore 8*a*. The lateral pin 8*b* is connected to a swash plate 9 arranged around the drive shaft 6 and is capable of changing the angle of inclination thereof with respect to a plane perpendicular to the rotating axis of the drive shaft 6.

A sleeve element 10 axially and slidably mounted on the drive shaft 6 is arranged adjacent to the rearmost end of the rotor 7, and is Constantly urged toward the rearmost end of the rotor 7 by a coil spring 11 arranged around the drive shaft 6 at a rear portion thereof. The sleeve element 10 has a pair of laterally extending trunnion pins 10*a* on which the swash plate 9 is pivoted so as to be inclined thereabout.

The swash plate 9 has an annular rear face and a cylindrical flange to support thereon a non-rotatable wobble plate 12 via a thrust bearing 9*a*. The non-rotatable wobble plate 12 has an outer periphery provided with a guide portion 12*a*, in which one of the long bolts 16 is fitted so as to prevent any rotational play of the wobble plate 12 on the swash plate 9, and the wobble plate 12 is operatively connected to pistons 15 axially and slidably fitted in the cylinder bores 1*b* via connecting rods 14. When the drive shaft 6 is rotated together with the rotor 7 and the swash plate 9, the wobble plate 12 on the swash plate 9 is non-rotatably wobbled, thereby causing reciprocation of respective pistons 15 in the cylinder bores 1*b*. In response to the reciprocation of the pistons 15, the refrigerant gas is drawn from the inner suction chamber 17 into respective cylinder bores 1*b* and compressed therein. The compressed refrigerant gas is discharged from respective cylinder bores 1*b* toward the annular discharge chamber 18, from which the refrigerant after compression is delivered to a refrigeration system of, for example, an automobile air-conditioner.

During the operation of the compressor, when a change in a pressure differential appears between a suction pressure in each cylinder bore 1*b* and a pressure prevailing in the crank chamber 5, the stroke of each piston 15 is changed, and therefore, the angle of inclination of the swash plate 9 and the wobble plate 12 is changed. The pressure in the crank chamber 5 is adjustably changed by a conventional solenoid control valve (not shown in FIG. 11) housed in an extended portion of the rear housing 4.

Figure 12:
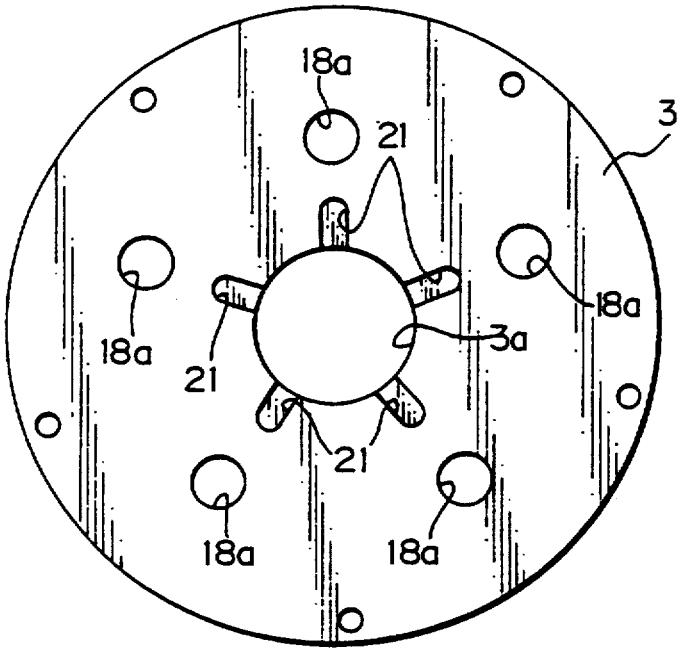
FIG. 12 is a cross-sectional view, taken along the line XII—XII of FIG. 11.

The afore-mentioned radially internally arranged suction chamber 17 of the rear housing 4 has a suction inlet 13*a* centrally formed in an end wall of the rear housing 4 so that the suction chamber 17 is capable of receiving a refrigerant gas therein when the refrigerant gas returns from the exterior of the compressor. The suction chamber 17 is directly communicated with the rear portion of the central bore 1*a* of the cylinder block 1 via a central bore 3*a* of the partitioning or valve plate 3 arranged so as to be coaxial with and having a bore diameter equal to the central bore 1*a* of the cylinder block, The partitioning plate 3 is provided with a plurality of (five in this embodiment) radial passageways 21 formed to extend radially from the central bore 3*a* thereof, as best shown in FIG. 12. The radial passageways 21 are provided as suction ports for the plurality of cylinder bores 1*b*. Therefore, an end of each radial passageway 21 is located so as to open toward the rearmost end of one of the cylinder bores 1*b* of the cylinder block 1.

A cylindrical rotary valve element 22 is smoothly and rotatably accommodated in the central bore 1*a* of the cylinder block 1 and the central bore 3*a* of the partition wall plate 3, and an axially inner end of the rotary valve element 22 is fixedly attached by a key 23 to an end of the drive shaft 6 extending into the central bore 1*a* of the cylinder block. The opposite outer end of the rotary valve element 22 is axially supported by a thrust bearing 24 seated in an annular step portion formed in the rear housing 4 at a position adjacent to the suction chamber 17. Thus, the rotary valve element 22 is rotated together with the drive shaft 6, The drive shaft 6 and the rotary valve element 22 of the compressor, according to the present embodiment, may be rotated in either the CW direction or CCW direction.

Figure 13:
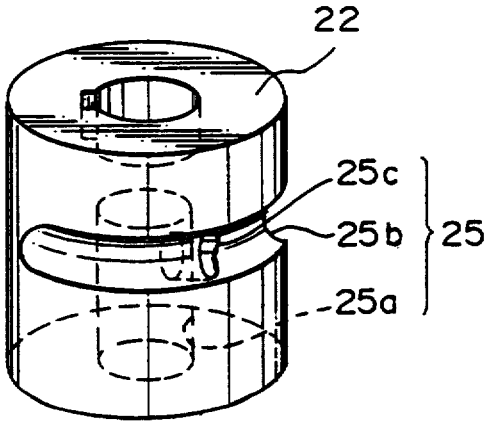
FIG. 13 is a perspective view of a rotary valve element capable of being incorporated in the compressor according to the fourth embodiment.
Figure 14:
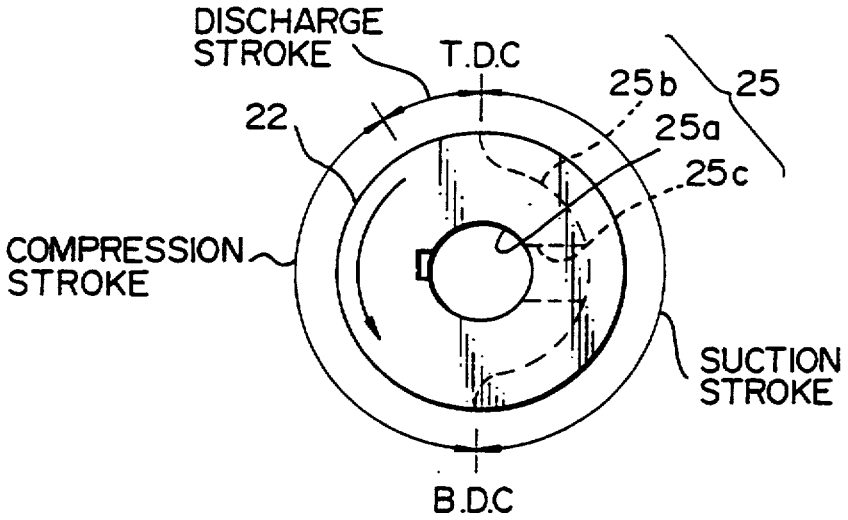
FIG. 14 is a plan view of the rotary valve element of FIG. 13, illustrating a relationship between the valve position during one revolution thereof and the valve operation.

As best shown in FIGS. 13 and 14, the cylindrical rotary valve element 22 is provided with a fluid passageway 25 including an axial blind bore 25*a* centrally formed therein, a groove 25*b* formed in the cylindrical surface thereof to circumferentially extend over approximately a half of the circumference thereof, and a radial bore 25*c* is formed to provide fluid communication between the central bore 25*a* and the circumferential groove 25*b*. The fluid passageway 25 of the rotary valve element 22 is provided to control the suction of the refrigerant from the suction chamber 17 of the rear housing 4 into respective cylinder bores 1*b*. Namely, during the rotation of the rotary valve element 22, while the circumferential groove 25*b* of the rotary valve element 22 is met with radial passageways, i.e., the suction ports 21 of the cylinder bores 1*b* in which the suction stroke of the pistons 15 is carried out, fluid communication is provided between these radial passageways 21 and the suction chamber 17 through the fluid passageway 25.

The annular discharge chamber 18 of the rear housing 4 arranged radially outside the suction chamber 17 can communicate with respective cylinder bores 1*b* via discharge ports 18*a* formed in the partition wall plate 3 and flapper type discharge valves of the discharge valve sheet 18*b* closing the discharge ports 18*a*. The movement of the discharge valves are restricted by valve retainers 20.

The above-described reciprocatory piston type compressor is incorporated in a refrigeration system of an air-conditioner such as an automobile air-conditioner to compress the refrigerant gas and deliver the Compressed gas into the refrigeration system through the delivery outlet 13*b* of the discharge chamber 18.

The operation of the compressor with the rotary valve element 22 will be described hereunder.

When the drive shaft 6 of the compressor is rotated about the rotating axis thereof by an external drive power, the swash plate 9 inclined from a plane perpendicular to the rotating axis of the drive shaft 6 rotates and wobbles around the drive shaft 6. The wobbling motion of the rotating swash plate 9 produces a synchronous wobbling of the non-rotatable wobble plate 12, so that the respective pistons 15 connected to the wobble plate 12 via the connecting rods 14 are reciprocated in the respective cylinder bores 1*b*. During the reciprocation of the pistons 15, when each of the pistons 15 starts to slide in the corresponding cylinder bore 1*b* from top dead center (T.D.C) toward bottom dead center (B.D.C) thereof so as to conduct a suction stroke thereof, the rotary valve element 22 rotating together with the drive shaft 6 in e.g., the CCW direction shown in FIG. 14, is brought into a position whereat the leading end of the circumferential groove 25*b* of the fluid passageway 25 thereof is met with the radial suction port 21 of the cylinder bore 1*b* and accordingly, the radial suction port 21 of the cylinder bore 1*b* is fluidly communicated with the suction chamber 17 via the fluid passageway 25 of the rotary valve element 22. Thus, the refrigerant gas is drawn from the suction chamber 17 into the cylinder bore 1*b* through the fluid passageway 25 and the radial suction port 21.

Subsequently, when the piston 15 is moved to the B.D.C in the cylinder bore 1*b*, the tail end of the circumferential groove 25*b* of the rotating rotary valve element 22 passes the radial suction port 21 of the cylinder bore 1*b*, in which the piston 15 arrives at the B.D.C.. Thus, the radial suction port 21 is disconnected from the suction chamber 17 by the rotary valve element 22, and when the piston 15 starts to slide in the cylinder bore 1*b* from the B.D.C toward the T.D.C thereof, the refrigerant gas drawn into the cylinder bore 1*b* is compressed by the piston 15, and therefore, a pressure prevailing in the cylinder bore 1*b* is gradually increased to a level capable of urging the discharge valve of the discharge valve sheet 18*b* to move from the closing toward the open position thereof. Accordingly, the compressed refrigerant gas is discharged from the cylinder bore 1*b* into the discharge chamber 18 via the discharge port 18*a* of the partition plate 3.

At this stage, it should be understood that the refrigerant gas introduced into the suction chamber 17 through the suction inlet 13*a* of the rear housing 4 is sequentially drawn into each of the plurality of cylinder bores 1*b* via the fluid passageway 25 of the rotary valve element and each of the respective radial suction ports 21 in response to the rotation of the rotary valve element 22. Namely, the suction valve means of the present embodiment does not employ the conventional flapper type suction valves. Accordingly, when the pistons 15 are at the suction stroke thereof in the corresponding cylinder bores 1*b*, the refrigerant gas is smoothly drawn into the cylinder bores 1*b* via the suction ports 21 irrespective of the pressure level in the cylinder bores 1*b* without the time delay that is encountered by the employment of the flapper type suction valves. Therefore, the wobble plate-operated reciprocatory piston type compressor can operate under a small pressure loss and at an enhanced volumetric efficiency. Further, even when the compressor is operated either under a high load or at a high speed, the pressure loss can be small, and employment of the rotary suction valve 22 can contribute to a reduction of noise during the operation of the compressor. Moreover, breakage of the suction valves as a result of the suction valves striking against the valve plate can be eliminated by using the rotary type suction valve 22.

It should further be noted that since the suction of the refrigerant gas from the suction chamber 17 into the cylinder bores 1*b* is carried out without a time delay due to the rotary suction valve 22, the refrigerant gas before compression is prevented from being in contact with the partition wall between the suction and discharge chambers 17 and 18 for a long time, and therefore the refrigerant gas can be drawn into the cylinder bores 1*b* as quickly as possible before it thermally expands due to the heat of the compressed gas transmitted via the partition wall. Accordingly, an excellent compression function can be exhibited.

According to the present embodiment of FIGS. 11 through 14, since the rotary valve element 22 is constructed as a rotary suction control valve rotating in synchronism with the drive shaft 6 of the compressor, it is possible to obtain a wide opening area of the suction control valve compared with the conventional flapper-form suction control valve. Therefore, the volumetric efficiency of the compressor per se can be raised due to a lowering of the amount of refrigerant pressure lost in each of the plurality of cylinder bores 1*b* of the compressor.

Further, since the rotary suction valve element 22 performs the suction control operation thereof by smooth rotation in the valve chamber, damage to and abrasion of the rotary suction control valve do not easily occur for a long operation time thereof. Thus, an improvement in the suction valve mechanism of the reciprocatory piston type compressor over the conventional flapper-type suction control valve can be realized.

Figure 11:
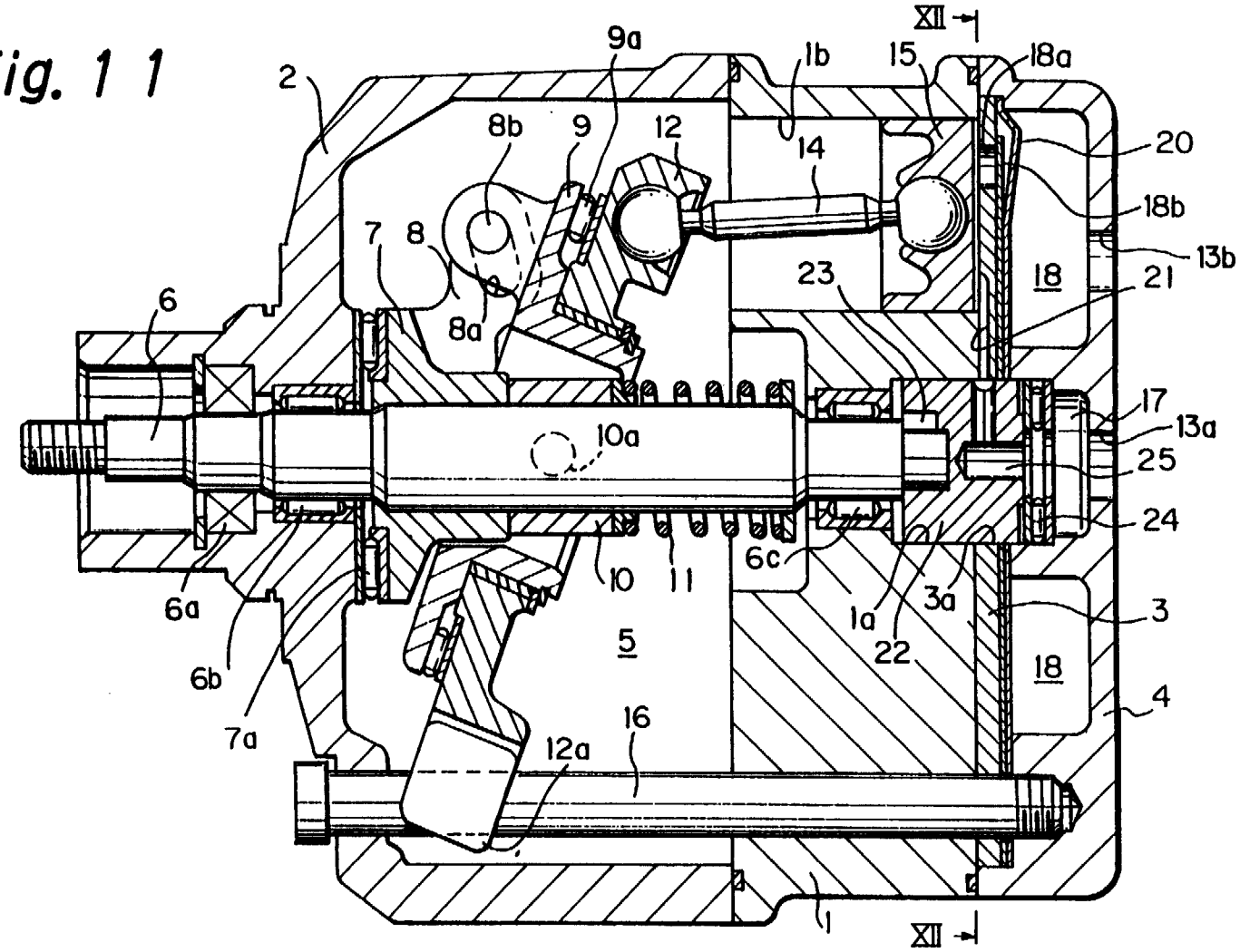
FIG. 11 is a longitudinal cross-sectional view of a reciprocatory piston type compressor, according to a fourth embodiment of the present invention.
Figure 15:
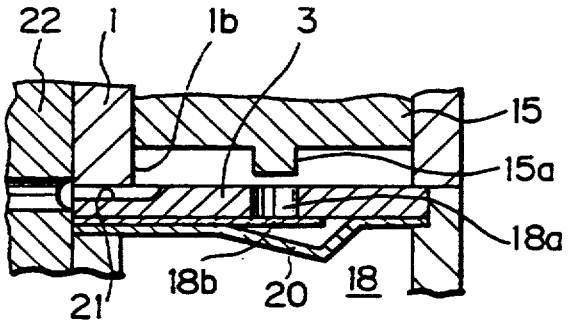
FIG. 15 is a cross-sectional view of an end of a piston and the corresponding cylinder bore, illustrating a variation of the embodiment of FIG. 11.

FIG. 15 illustrates a modification of the reciprocatory piston type compressor of FIG. 11. Namely, when the rotary valve element 22 is incorporated in the compressor as a suction control valve, the conventional valve sheet 18*b* having flapper type or reed type discharge control valves are arranged so as to be in contact with the partition and the valve plate 3. Therefore, the discharge ports 18*a* of the partition valve plate 3, through which the compressed refrigerant is discharged from the respective cylinder bores 1*b* toward the discharge chamber 18, may be provided in a position such that the center of each discharge port 18*a* is in correct alignment with the central axis of the corresponding cylinder bore 1*b*. Thus, each reciprocatory piston 15 may have a projection 15*a* at the head thereof so as to be engageable with the corresponding discharge port 18*a* in response to the movement of the piston 15 toward top dead center (T.D.C) thereof, and accordingly, the piston 15 can always be moved in the cylinder bore 1*b* to a position permitting a minimal gap between the piston head thereof and the inner end face of the partition and valve plate 3. Therefore, the amount of compressed refrigerant gas remaining in the cylinder bore 1*b* without being discharged therefrom is minimal so that the volumetric efficiency of the compressor can be increased.

Figure 16:
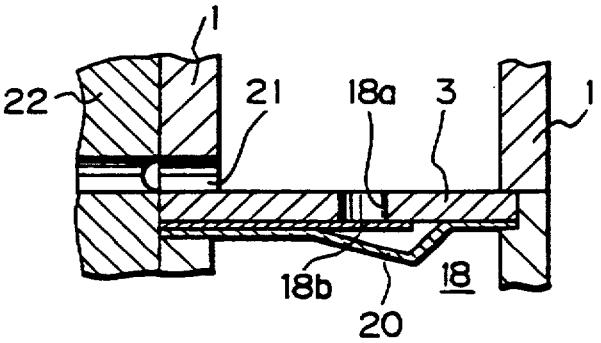
FIG. 16 is a partial cross-sectional view of an end of one cylinder bore, illustrating another variation of the embodiment of FIG. 11.

FIG. 16 illustrates another modification of the reciprocatory piston type compressor of FIG. 11. Namely, in the construction of the compressor of FIG. 16, the radial passageways (the suction ports) 21 are arranged in the cylinder block 1 instead of the afore-described partition and valve plate 3. As a result, the length of each radial passageway 21 can be made shorter, and accordingly, any compressed refrigerant gas remaining in the radial passageway 21 at the time the piston 15 comes to the end of the discharge stroke thereof can be reduced to the minimal amount. Consequently, the volumetric efficiency of the compressor can be raised.

Figure 17:
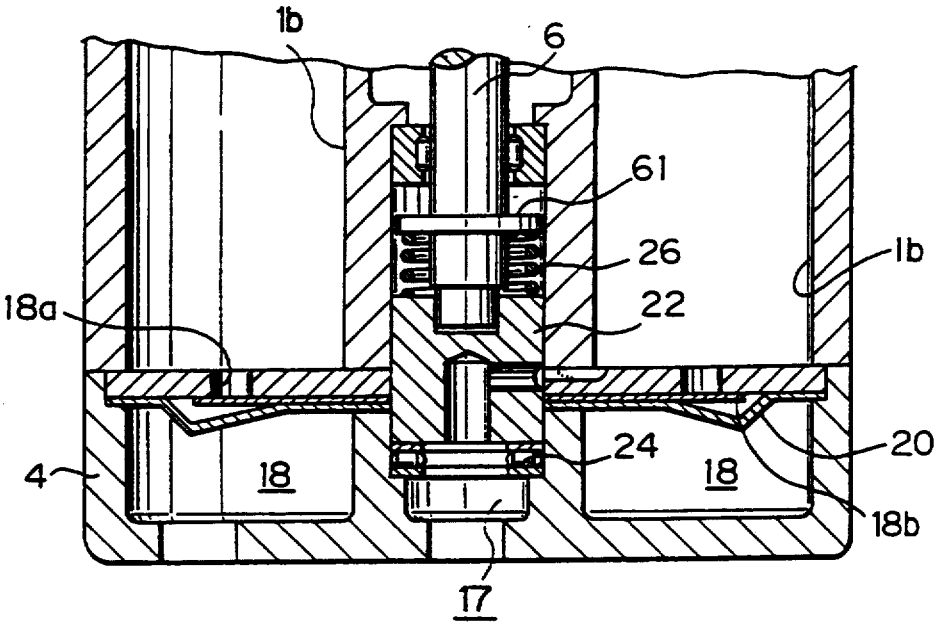
FIG. 17 is a cross-sectional view of a part of the compressor, illustrating a further variation of the embodiment of FIG. 11.

FIG. 17 illustrates a further modification of the reciprocatory piston type compressor of FIG. 11. Namely, in the construction of the compressor of FIG. 17, the drive shaft 6 is provided with a flange portion 61 to support one end of a coil spring 26, the other end of which is in contact with the rotary valve element 22, thereby always urging the rotary valve element 22 toward the thrust bearing 24 seated in the rear housing 4. Thus, any axial play of the rotary valve element 22 can be cancelled, thereby ensuring a smooth rotation of the rotary valve element 22, and accordingly, abrasion and seizure of the rotary valve element 22 can be prevented. Further, difficulty in controlling the dimension and size of the rotary valve element 22 during the production and assembly stages thereof can be mitigated.

Figure 18:
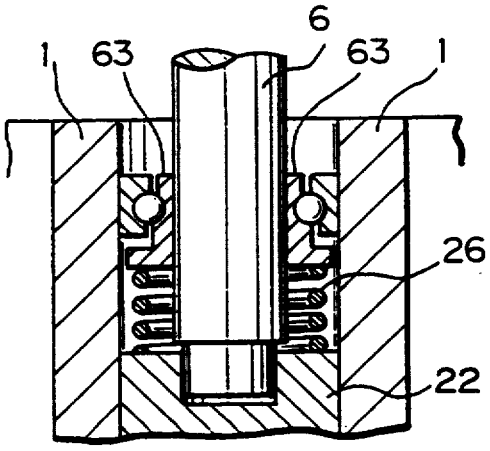
FIG. 18 is a cross-sectional view of an end of the drive shaft and the related portion thereof, illustrating a still further variation of the embodiment of FIG. 11.

The coil spring 26 of FIG. 17 may be arranged between the rotary valve element 22 and a radial bearing 63 shown in FIG. 18, which is arranged so as to rotatably support the drive shaft 6 instead of the bearing 6*b* of FIG. 11 or FIG. 17. The bearing 63 is provided with a flanged inner race against which the end of the coil spring 26 is bore, and therefore, the drive shaft 6 can be made of a straight member having no flange. Namely, an assembly of the rotary valve element 22 can be simplified compared with the compressor of FIG. 17.

Figure 19:
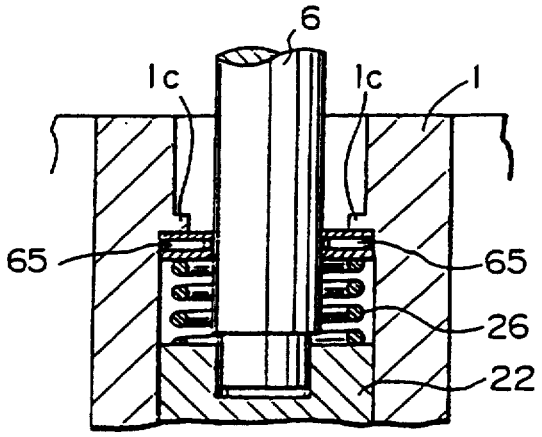
FIG. 19 is a cross-sectional view of an end of the drive shaft and the related portion thereof, illustrating a further variation of the embodiment of FIG. 11.

FIG. 19 illustrates another modification in which the spring 26 urging the rotary valve element 22 is supported by a thrust bearing 65 seated on a step 1*c* of the cylinder block 1. Thus, assembly of the rotary valve element 22 can be simple, similarly to the embodiment of FIG. 18.

Figure 20:
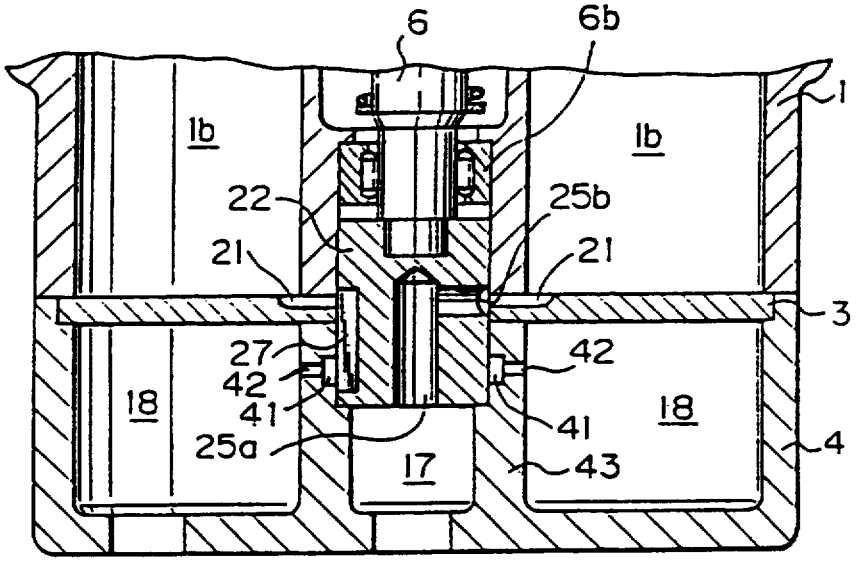
FIG. 20 is a cross-sectional view of a part of a reciprocatory piston type compressor according to the fifth embodiment of the present invention.
Figure 21:
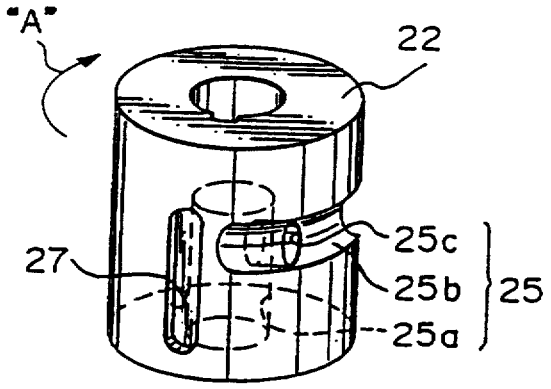
FIG. 21 is a perspective view of a rotary valve element accommodated in the compressor of the fifth embodiment.
Figure 22:
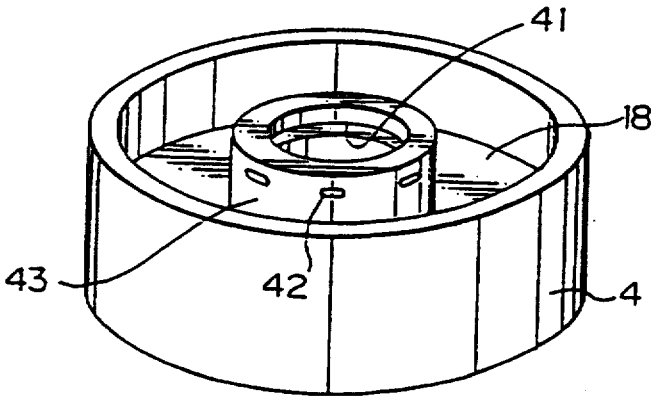
FIG. 22 is a perspective view of a rear housing of the compressor of the fifth embodiment.
Figure 23:
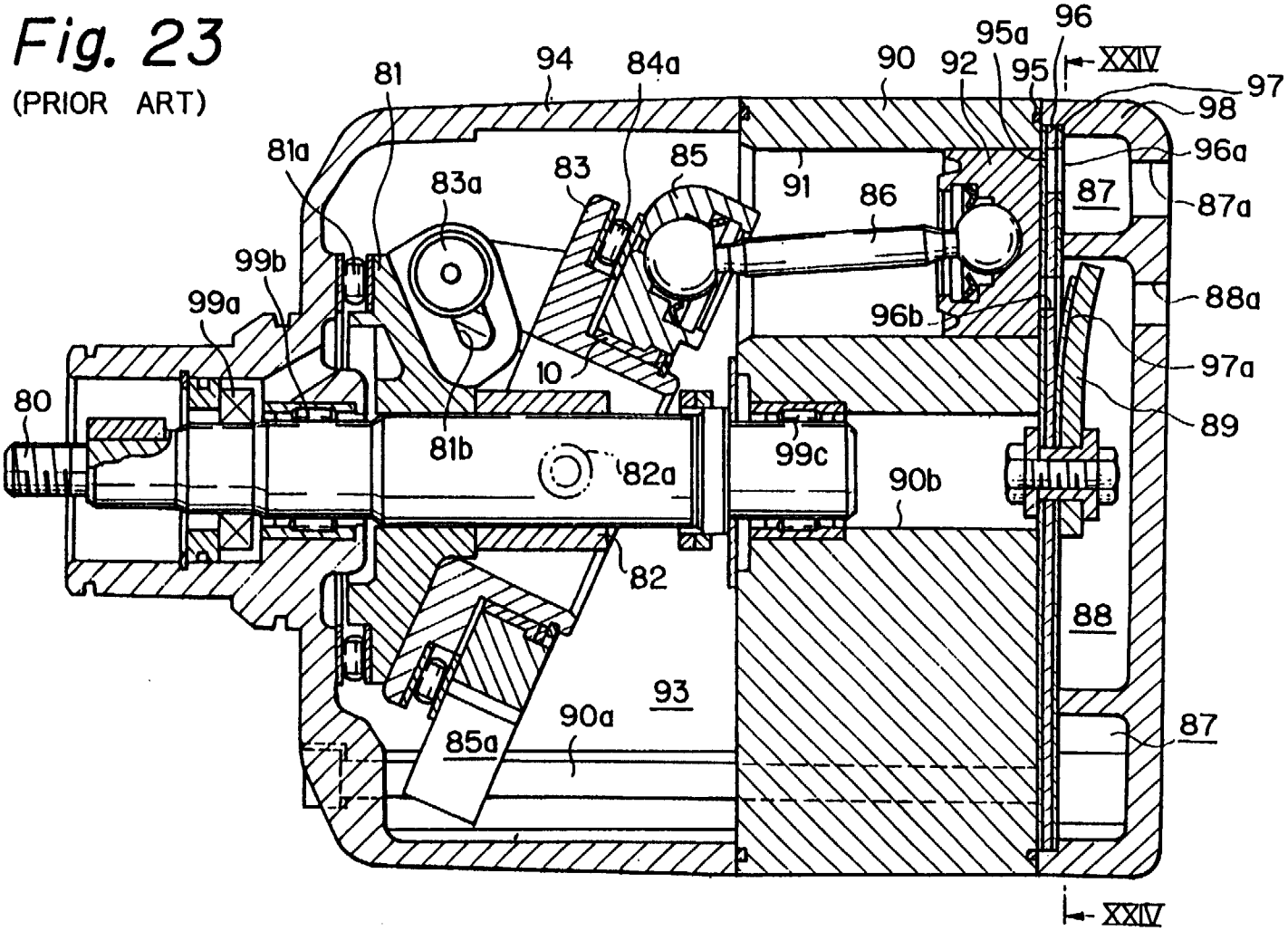
Fig. 23 (PRIOR ART)
FIG. 23 is a longitudinal cross-sectional view of a reciprocatory piston type compressor according to the prior art.
Figure 24:
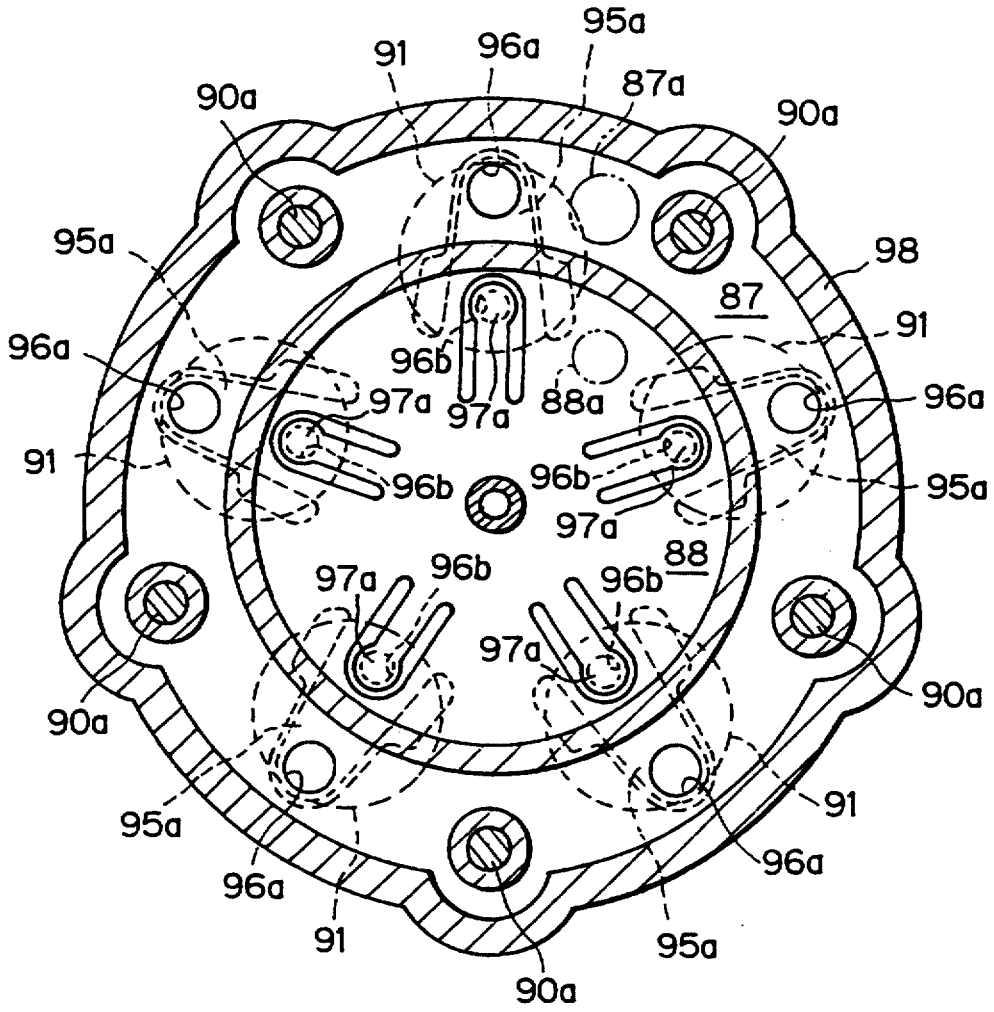
Fig. 24 (PRIOR ART)
FIG. 24 is a cross-sectional view, taken along the line XXIV—XXIV of FIG. 23.

FIGS. 20 through 22 illustrate a further embodiment of the present invention, and the same and like elements and portions as those of the first and second embodiments are designated by the same reference numerals.

Referring to FIGS. 20 through 22, the rotary valve element 22 is arranged in the valve chamber defined by the central bore 1*a* of the cylinder block 1, the central bore 3*a* of the partition plate 3, and a portion of an internal cylindrical wall 43 (FIG. 22) of the rear housing 4. It is to be noted that in the present embodiment, the rotary valve element 22 is provided as a rotating valve having the ability to control both suction and discharge of the refrigerant with respect to the plurality of cylinder bores 1*b* of the cylinder block 1. Therefore, the compressor has no flapper type valve. It should, however, be noted that the suction, compression, and discharge operations are effected by reciprocation of the pistons 15 in the cylinder bores 1*b* caused by the swash and wobble plates when driven by the drive shaft 6 in the same manner as the compressor of the first and second embodiments.

The description of the construction and operation of the rotary valve element 22 capable of exhibiting both suction and discharge control performance will be given below.

Referring to FIGS. 20, and 21, the rotary valve element 22 attached to an end of the drive shaft 6 is provided with a fluid passageway 25 including an axial blind bore 25*a* centrally formed therein, a circumferential groove 25*b* formed in the cylindrical outer surface thereof, and a radial passageway 25*c* providing a connection between the bore 25*a* and the groove 25*b* for controlling the supply of refrigerant gas before compression from the suction chamber 17 to the respective cylinder bores 1*b* while the respective cylinder bores 1*b* are in the suction stage.

The rotary valve element 22 is also provided with an axially extending groove-like passageway 27 formed in the cylindrical outer surface thereof. The passageway 27 is located adjacent to but spaced from one end, i.e., a leading end of the circumferential groove 25*b* of the fluid passageway 25 when considering a predetermined rotating direction of the rotary valve element 22, shown by an arrow "A" in FIG. 21. The spacing between the passageway 27 and the leading end of the circumferential groove 25*b* is selected and designed in the manner described later.

As shown in FIG. 20, one end of the axial groove-like passageway 27 is disposed adjacent to the rearmost end of the rotary valve element 22, and the other end thereof is disposed at a position whereat the passageway 27 is capable of communicating with the respective radial passageways 21 of the partition plate 3 (FIG. 20) during the rotation of the rotary valve element 22.

Referring to FIGS. 20 and 22, the cylindrical wall 43 of the rear housing 4 is provided with an internal annular groove 41 at a position capable of being constantly exposed to the above-mentioned axial groove 27 of the rotary valve element 22, and an appropriate number of radial bores 42 connecting the discharge chamber 18 and the internal annular groove 41 of the cylindrical wall 43 of the rear housing 4.

In accordance with the above-described construction and arrangement of the rotary valve element 22, when the rotary valve element 22 is rotated together with the drive shaft 6, and when the axial passageway 27 attains positions whereat it is met with the radial passageway 21 of the cylinder bore 1*b* wherein the discharge stroke of the piston 15 follows, the cylinder bore 1*b* is fluidly communicated with the discharge chamber 18 of the rear housing 4 via the radial passageway 21 and the axial passageway 27 of the rotary valve element 22. The fluid communication of the axial passageway 27 of the rotary valve element 22 with respective cylinder bores 1*b* sequentially occurs, thereby permitting the compressed refrigerant to be discharged from the cylinder bores 1*b* toward the discharge chamber 18 in response to the rotation of the rotary valve element 22. Namely, the rotary control valve element 22 has the function of controlling the discharge of the compressed refrigerant gas from the respective cylinder bores 1*b* toward the discharge chamber 18 during rotation thereof in synchronism with the drive shaft 6, in addition to the aforementioned suction control function.

When the rotary valve element 22 is provided with both the fluid passageway 25 and the axial passageway 27, a predetermined spatial relationship between these two fluid passageways is established so as to obtain appropriate control of both suction and discharge of the refrigerant with respect to respective cylinder bores 1*b*.

In accordance with the above-mentioned arrangement of the fluid passageway 25 and the circumferential passageway 27 of the rotary valve element 22, it is ensured that the circumferential outer surface of the rotary valve element 22 is provided with a predetermined length portion between the axial passageway 27 and the leading end of the circumferential passageway 25*b*, as clearly shown in FIG. 21. Thus, each of the cylinder bores 1*b* does not simultaneously communicate with both suction and discharge chambers 17 and 18 of the rear housing 4 via the rotary valve element 22, and accordingly, the compressed refrigerant does not leak directly from the cylinder bore 1*b* toward the suction chamber 17, When the rotary valve element 22 is provided with both suction and discharge control functions, pressure loss of the refrigerant gas during the operation of the reciprocatory piston type compressor can be lowered significantly compared to the compressor provided with the conventional flapper-form suction and discharge valves, and accordingly, the volumetric efficiency of the compressor can be enhanced significantly. Further, elimination of the flapper-form valves from the compressor can contribute significantly to a reduction of noise during the operation of the compressor and to a reduction in valve damage during the operation life of the compressor, Further, since the single rotary valve element 22 controls the suction and discharge operations of the refrigerant with respect to the plurality of cylinder bores 1*b*, it is possible to reduce the number of elements for constructing one reciprocatory piston type compressor, while simplifying the construction of the compressor. Thus, the manufacturing costs of the reciprocatory piston type compressor can be lowered.

In the described embodiments, the reciprocatory piston type compressor is provided with a plurality of cylinder bores, in which a plurality of single-headed pistons are reciprocated to effect suction, compression, and discharge operations under the control of the rotary valve element. Nevertheless, it should be understood that the rotary valve element formed as a rotary suction control valve or a rotary suction and discharge control valve can equally be applicable to the other reciprocatory piston type compressors provided with a plurality of double-headed reciprocatory pistons reciprocated by a swash plate mechanism having a fixed inclination angle. Namely, in the case of the double headed piston type compressor, two rotary valve elements are attached to opposite ends of a rotating drive shaft, thereby causing rotating and wobbling motions of the swash plate in the swash plate chamber provided in the center of the cylinder block.

From the foregoing description, it will be understood that according to the present invention, a reciprocatory piston type refrigerant compressor has a small pressure loss due to the prevention of a time delay in the suction and the discharge of the refrigerant gas.

Further, in accordance with the present invention, a reciprocatory piston type compressor free of noise and damage to the elements and components of the compressor can be obtained.

It should, however, be noted that many further variations and modifications will occur to persons skilled in the art without departing from the spirit and scope of the present invention as claimed in the appended claims.

We claim:

1. A reciprocatory piston type refrigerant compressor for compressing a refrigerant of a refrigeration system comprising:

a compressor body including:

an open ended cylinder block provided with a central axis thereof, a cylindrical central bore formed to be coaxial with the central axis, and a plurality of axial cylinder bores arranged around and parallel to the central axis; and a housing means connected to axial opposite ends of said cylinder block for air-tightly closing said axial opposite ends of said cylinder block;

a suction chamber for the refrigerant before compression, defined in a part of said compressor body so as to receive therein the refrigerant before compression from said refrigeration system, said suction chamber being in communication with said plurality of cylinder bores via a plurality of suction ports;

a discharge chamber for the refrigerant after compression, defined in said housing means of said compressor body so as to receive therein the refrigerant after compression to be delivered toward said refrigeration system, said discharge chamber being in communication with said plurality of cylinder bores via a plurality of discharge ports;

a rotatable drive shaft having axial ends thereof rotatably supported by bearings seated in said housing means and said cylinder block of said compressor body;

a plurality of reciprocatory pistons fitted in said plurality of axial cylinder bores of said cylinder block, each piston being reciprocated in one of said plurality of cylinder bores for suction, compression, and discharge of the refrigerant;

a swash plate-operated piston drive mechanism arranged in said compressor body around said rotatable drive shaft for driving reciprocation of said plurality of reciprocatory pistons in said plurality of cylinder bores in cooperation with said drive shaft;

A suction valve means in communication with the suction chamber and rotatable together with the drive shaft arranged for closing said plurality of suction ports and movable to open said plurality of suction ports in a predetermined sequence;

The suction valve means comprising a plate having a first surface disposed to communicate with the suction chamber and a second surface adjacent the suction ports, the plate having a circularly elongated through hole passing through the first surface and, the second surface arranged to pass gas from the suction chamber to the suction ports; and A discharge valve means arranged for closing said plurality of discharge ports and movable to open said plurality of discharge ports in a predetermined sequence.

* * * * *